US010722049B2

(12) United States Patent
Waters et al.

(10) Patent No.: US 10,722,049 B2
(45) **Date of Patent: *Jul. 28, 2020**

(54) REVERSIBLE CRIB SHIELD SYSTEM

(71) Applicant: BreathableBaby, LLC, Minnetonka, MN (US)

(72) Inventors: Dale Richard Waters, Eagan, MN (US); Susan Marie Waters, Eagan, MN (US)

(73) Assignee: BREATHABLEBABY, LLC, St. Louis Park, MN (US)

( * ) Notice: Subject to any disclaimer, the term of this patent is extended or adjusted under 35 U.S.C. 154(b) by 856 days.

This patent is subject to a terminal disclaimer.

(21) Appl. No.: 15/196,021

(22) Filed: Jun. 28, 2016

(65) Prior Publication Data

US 2017/0367499 A1 Dec. 28, 2017

(51) Int. Cl.

| | |
|---|---|
| ***A47D 15/00*** | (2006.01) |
| ***A47D 13/06*** | (2006.01) |
| ***A47D 7/00*** | (2006.01) |
| ***A47D 9/00*** | (2006.01) |

(52) U.S. Cl.

CPC ..... *A47D 15/008* (2013.01); *A47D 7/00* (2013.01); *A47D 9/00* (2013.01); *A47D 13/06* (2013.01)

(58) Field of Classification Search

CPC .... A47D 13/063; A47D 13/061; A47D 13/06; A47D 9/00; A47D 9/005; A47D 15/00; A47D 15/08; A47D 7/00; A47D 7/002; A47D 15/008

USPC ..... 5/424, 425, 427, 93.1, 99.1, 100, 663, 5/946

See application file for complete search history.

(56) References Cited

U.S. PATENT DOCUMENTS

| | | | |
|---|---|---|---|
| 1,056,712 | A | 3/1913 | Schweda |
| 2,128,978 | A | 9/1938 | Akin |
| 2,566,790 | A | 9/1951 | Bloomfield |
| 2,727,242 | A | 2/1954 | Pascal |
| 2,784,420 | A | 3/1957 | Moltane |
| 2,808,596 | A | 10/1957 | Schreiner |
| 2,927,331 | A | 3/1960 | Ruiz |
| 3,103,669 | A | 9/1963 | Mundis |

(Continued)

FOREIGN PATENT DOCUMENTS

| | | | | |
|---|---|---|---|---|
| CA | 3017581 A1 * | 3/2019 | ..... | A47D 15/00 |
| DE | 102006024855 A1 | 12/2007 | | |

(Continued)

OTHER PUBLICATIONS

"Safe-N-Secure Crib Liner" datasheet [online]. Tender Creations, Inc., Southampton, MN, [retrieved on Feb. 4, 2000]. Retrieved from the Internet<URL:http://www.tendercreations.com/cribliner.htm>; 8 pgs.

(Continued)

*Primary Examiner* — Robert G Santos
(74) *Attorney, Agent, or Firm* — Winthrop & Weinstine, P.A.; Alicia Griffin Mills

(57) ABSTRACT

A crib liner constructed of breathable material having a reduced suffocation resistance level for infant and toddler use. In some configurations, the breathable material may include an inner fabric, outer fabric, and a pile substructure between the front and back substructures, thereby allowing air to move effectively therethrough.

18 Claims, 27 Drawing Sheets

(56) References Cited

U.S. PATENT DOCUMENTS 3,183,527 A 5/1965 Turner
3,199,123 A 8/1965 Komiske
3,241,158 A * 3/1966 Berl ..... A47C 21/026 5/424
3,325,832 A 6/1967 Malicki
3,438,069 A 4/1969 Long
3,619,824 A 11/1971 Doyle
3,877,090 A 4/1975 Schutz
3,882,871 A 5/1975 Taniguchi
4,232,415 A 11/1980 Webber
4,280,342 A 7/1981 Eng et al.
4,370,765 A 2/1983 Webber
4,518,649 A * 5/1985 Wang ..... D06M 15/277 427/393.4
4,526,830 A 7/1985 Ferziger et al.
4,579,753 A 4/1986 Gjendemsjo
4,644,591 A 2/1987 Goldberg
4,670,923 A 6/1987 Gabriel et al.
4,716,594 A * 1/1988 Shannon ..... A41D 13/001 2/4
4,724,558 A 2/1988 Reiff
4,750,225 A 6/1988 Simons et al.
4,767,419 A 8/1988 Fattore
4,864,669 A 9/1989 Jones
4,885,200 A * 12/1989 Perdelwitz, Jr. ..... B60N 2/2812 428/136
4,886,697 A * 12/1989 Perdelwitz, Jr. ..... A47C 27/005 428/192
4,890,346 A 1/1990 Rist
4,892,769 A * 1/1990 Perdelwitz, Jr. ..... A47C 31/001 428/68
4,900,377 A * 2/1990 Redford ..... B32B 27/12 156/62.2
4,914,772 A 4/1990 Difloe
4,922,565 A 8/1990 Blake
5,010,611 A 4/1991 Mallett
5,027,457 A 7/1991 Sweet
5,086,530 A 2/1992 Blake
5,093,947 A 3/1992 Henegar et al.
5,111,544 A 5/1992 Graebe
5,241,718 A 9/1993 Pope
5,385,036 A 1/1995 Spillane et al.
5,410,765 A 5/1995 Youngblood
5,421,046 A 6/1995 Vande Streek
5,509,157 A 4/1996 Story
5,515,559 A 5/1996 Benson
5,517,707 A 5/1996 LaMantia
5,566,407 A 10/1996 Lien
5,575,025 A 11/1996 Peters
5,577,276 A 11/1996 Nicholson et al.
5,600,850 A * 2/1997 Shannon ..... A41D 13/001 2/4
5,642,545 A 7/1997 Howard
5,699,571 A 12/1997 Yowell
5,706,534 A 1/1998 Sherman
5,787,534 A 8/1998 Hargest et al.
5,788,332 A 8/1998 Hettinga
5,806,112 A 9/1998 Harms
5,855,031 A 1/1999 Swift, Jr.
5,857,232 A 1/1999 Mahdavi
5,870,785 A 2/1999 Hoorens
5,881,408 A * 3/1999 Bashista ..... A47D 15/008 5/663
5,897,164 A 4/1999 Kagan et al.
5,933,885 A 8/1999 Glassford
5,937,458 A 8/1999 DeRosa
5,950,264 A 9/1999 Wyner et al.
6,012,189 A 1/2000 Dudley
6,012,756 A * 1/2000 Clark-Dickson ..... B62B 9/142 296/107.02
6,017,601 A 1/2000 Amsel
6,019,421 A 2/2000 Roh
6,039,393 A 3/2000 Roh
6,055,690 A 5/2000 Koenig
6,079,980 A 6/2000 Durand
6,089,947 A 7/2000 Green
6,119,288 A 9/2000 Hendrickson
D433,851 S 11/2000 Roh
6,151,733 A 11/2000 Takashima
6,168,495 B1 1/2001 Yoon
6,170,101 B1 * 1/2001 McCloud ..... A47D 15/008 5/424
6,174,584 B1 1/2001 Keller et al.
6,178,573 B1 * 1/2001 Wagner ..... A47D 15/008 5/424
6,243,895 B1 6/2001 Amin
D444,329 S 7/2001 Newman
6,256,813 B1 7/2001 Aaron
6,263,529 B1 7/2001 Chadwick et al.
6,302,487 B1 * 10/2001 Fujita ..... B60N 2/5825 297/452.56
6,315,364 B1 * 11/2001 Fujita ..... A47C 7/24 297/452.56
6,347,422 B2 2/2002 Heavrin
6,421,857 B2 7/2002 Whatman et al.
6,438,775 B1 8/2002 Koenig
6,489,000 B1 * 12/2002 Ogura ..... A47C 23/26 428/45
6,550,083 B1 4/2003 LaMantia
6,564,403 B1 5/2003 Titus
6,618,880 B1 9/2003 Chase
6,670,018 B2 * 12/2003 Fujita ..... D04B 21/02 428/156
6,681,421 B2 1/2004 Carroll
6,684,437 B2 2/2004 Koenig
6,718,577 B2 4/2004 Li
6,718,578 B2 4/2004 Li
6,754,919 B2 6/2004 Leaphart, Jr. et al.
6,772,457 B1 8/2004 Alaback
6,859,958 B2 3/2005 LaMantia
6,859,962 B2 3/2005 Diak/Ghanem
6,910,896 B1 6/2005 Owens et al.
6,934,985 B2 8/2005 Sanders
D510,217 S 10/2005 Neveau
6,957,464 B1 10/2005 Coauette
6,971,130 B2 12/2005 Chase
7,003,823 B1 2/2006 Reed et al.
7,007,325 B1 3/2006 Gomeh
7,055,192 B2 6/2006 Waters et al.
7,107,638 B2 9/2006 Wilson
7,181,797 B2 2/2007 Chase
D584,555 S 1/2009 Estee
7,523,513 B2 4/2009 Waters et al.
7,694,364 B1 4/2010 Toma
7,743,442 B2 6/2010 Maloney et al.
7,793,368 B2 9/2010 Burrell, IV
7,887,387 B2 2/2011 Colvin
7,966,668 B2 6/2011 Bay
8,069,496 B2 12/2011 Sesselmann
8,161,584 B1 4/2012 Del Rio
8,220,088 B2 7/2012 Waters et al.
8,321,980 B2 12/2012 Maloney
8,336,136 B1 12/2012 Lantos
8,365,323 B2 2/2013 Crumrine
8,434,179 B2 * 5/2013 Reeves ..... A47D 15/008 5/663
8,539,626 B2 * 9/2013 Dunne ..... A47D 15/00 5/424
8,590,081 B1 * 11/2013 Dunne ..... A47D 15/00 5/424
8,646,128 B2 * 2/2014 Kaplan ..... A47D 15/008 5/424
8,661,581 B2 * 3/2014 Kaplan ..... A47D 15/008 5/424
8,689,379 B2 4/2014 Cicci
8,713,734 B2 5/2014 Davis
8,793,813 B2 8/2014 Waters et al.
8,887,332 B2 11/2014 Alletto
8,959,683 B2 2/2015 Rochlin
9,015,883 B2 4/2015 Alletto
9,038,222 B2 5/2015 Cicci
9,167,922 B1 10/2015 Holbrook et al.

(56) References Cited

U.S. PATENT DOCUMENTS

| | | | | |
|---|---|---|---|---|
| 9,167,923 | B1 | 10/2015 | Holbrook et al. | |
| 9,204,731 | B2 | 12/2015 | Corodemus | |
| 9,247,826 | B1 | 2/2016 | Holbrook et al. | |
| 9,265,369 | B1 | 2/2016 | Beliveau | |
| 9,615,615 | B2 | 4/2017 | Slank | |
| 10,016,064 | B2 | 7/2018 | Corodemus | |
| 10,492,624 | B2 * | 12/2019 | Marton | A47D 15/008 |
| 10,588,436 | B2 * | 3/2020 | Waters | A63H 3/02 |
| 10,588,437 | B2 * | 3/2020 | Waters | A47D 15/008 |
| 2001/0000362 | A1 * | 4/2001 | Wagner | A47D 15/008 5/424 |
| 2002/0034901 | A1 * | 3/2002 | Fujita | D04B 21/02 442/32 |
| 2003/0033656 | A1 | 2/2003 | Jaeger | |
| 2003/0080248 | A1 | 5/2003 | Morgan | |
| 2003/0224691 | A1 | 12/2003 | Carey | |
| 2004/0083697 | A1 | 5/2004 | Niakin | |
| 2004/0128764 | A1 | 7/2004 | McGrath et al. | |
| 2004/0158910 | A1 | 8/2004 | Bay | |
| 2004/0199999 | A1 | 10/2004 | Landry | |
| 2005/0132498 | A1 | 6/2005 | Vrionis | |
| 2005/0177942 | A1 | 8/2005 | Finn | |
| 2005/0196075 | A1 | 9/2005 | Heidel | |
| 2005/0217030 | A1 | 10/2005 | Seigler | |
| 2006/0010608 | A1 | 1/2006 | DeFranks et al. | |
| 2007/0289060 | A1 | 12/2007 | Berkey | |
| 2009/0313755 | A1 | 12/2009 | Burrell, VI | |
| 2010/0154119 | A1 | 6/2010 | Shuttleworth | |
| 2011/0041247 | A1 | 2/2011 | Moon | |
| 2011/0113552 | A1 | 5/2011 | Miller | |
| 2012/0278995 | A1 * | 11/2012 | Kaplan | A47D 15/008 5/663 |
| 2012/0311792 | A1 * | 12/2012 | Reeves | A47D 15/008 5/724 |
| 2012/0317721 | A1 * | 12/2012 | Dunne | A47D 15/008 5/424 |
| 2013/0074260 | A1 | 3/2013 | Diamant | |
| 2013/0097784 | A1 * | 4/2013 | Kaplan | A47D 15/00 5/663 |
| 2013/0283533 | A1 | 10/2013 | Bendickson | |
| 2013/0333112 | A1 * | 12/2013 | Dunne | A47D 15/008 5/424 |
| 2014/0096320 | A1 * | 4/2014 | Wilson | A47D 15/008 5/424 |
| 2014/0196211 | A1 * | 7/2014 | Kaplan | A47D 15/00 5/424 |
| 2014/0223664 | A1 | 8/2014 | Kanbar | |
| 2015/0164228 | A1 | 6/2015 | Scorgie | |
| 2015/0342370 | A1 | 12/2015 | Ashworth | |
| 2015/0351563 | A1 | 12/2015 | Alletto | |
| 2015/0359353 | A1 | 12/2015 | Vainberg | |
| 2016/0015193 | A1 | 1/2016 | Alletto | |
| 2016/0166092 | A1 | 6/2016 | Alletto | |
| 2016/0331159 | A1 | 11/2016 | Alletto | |
| 2017/0020312 | A1 | 1/2017 | Davis | |
| 2017/0035215 | A1 | 2/2017 | Scorgie | |
| 2017/0055737 | A1 | 3/2017 | Rochlin | |
| 2017/0065093 | A1 | 3/2017 | Scorgie | |
| 2017/0099967 | A1 | 4/2017 | Holbrook | |
| 2017/0367496 | A1 * | 12/2017 | Waters | A47D 7/00 |
| 2017/0367497 | A1 * | 12/2017 | Waters | A47D 15/008 |
| 2017/0367498 | A1 * | 12/2017 | Waters | A47D 15/008 |
| 2017/0367499 | A1 * | 12/2017 | Waters | A47D 15/008 |
| 2018/0027999 | A1 * | 2/2018 | Marton | A47D 15/008 |
| 2019/0082859 | A1 * | 3/2019 | Marton | A47D 15/008 |
| 2019/0261791 | A1 * | 8/2019 | Marton | A47G 9/0223 |
| 2019/0374046 | A1 * | 12/2019 | Waters | A47D 15/008 |
| 2020/0037793 | A1 * | 2/2020 | Waters | A47D 15/006 |

FOREIGN PATENT DOCUMENTS

| | | | |
|---|---|---|---|
| FR | 2867045 | A1 | 9/2005 |
| WO | 9956588 | A2 | 11/1999 |

OTHER PUBLICATIONS

"Baby Carrier Air" datasheet [online]. Babybjorn AB, Danderyd, Sweden, [retrieved on Nov. 3, 2006]. Retrieved from the Internet: <URL:http://www.babybjorn.com/TemplatesWeb/ProductDetails.asp?ItemId=2284>; 1 page.

"Cozy Crib Tent" magazine advertisement. Tots in Mind, Inc., Salem, NH; 1 page.

"High-Tech Toy Testing Equipment" datasheet [online]. U.S. Consumer Product Safety Commission [retrieved on Feb. 15, 2007]. Retrieved from the Internet: URL:http://www.cpsc.gov/cpscput/prerel/prhtm101/0155.html; 2 pgs.

"Virtual Child Model" datasheet [online]. Nemours, Jacksonville, FL, [retrieved on Feb. 15, 2007]. Retrieved from the Internet: URL:http//nemours.org/internet?url=no/news/releases/2000/001212_unsafe_toys_html; 2 pgs.

Safe-N-Secure Crib Liner, 1998 Show Directory, The 29th Annual International Juvenile Products Show, Oct. 25-28, 1998 (Dallas, Texas).

Cribble™ Crib Slat Safety Wraps, The 1999 International Juvenile Products Show Directory Oct. 23-26, 1999 (Dallas, Texas).

Defendant's Prior Art Chart from Prior Art Statement in *BreathableBaby, LLC* v. *Crown Crafts, Inc. and Crown Crafts Infant Products, Inc.*, Civil Case No. 12-cv-00094 (PJS/TNL) before the United States District Court, District of Minnesota.

Plaintiffs Response to Prior Art Statement in *BreathableBaby, LLC* v. *Crown Crafts, Inc. and Crown Crafts Infant Products, Inc.*, Civil Case No. 12-cv-00094 (PJS/TNL) before the United States District Court, District of Minnesota.

Gershman, Maurice, M.D. "Self-Adhering Nylon Tapes," Journal of A.M.A. (vol. 168, No. 7) Oct. 18, 1958.

* cited by examiner

FIG. 2A
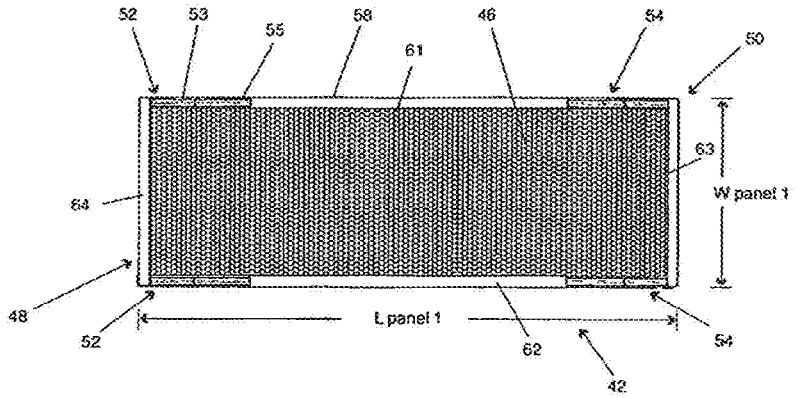
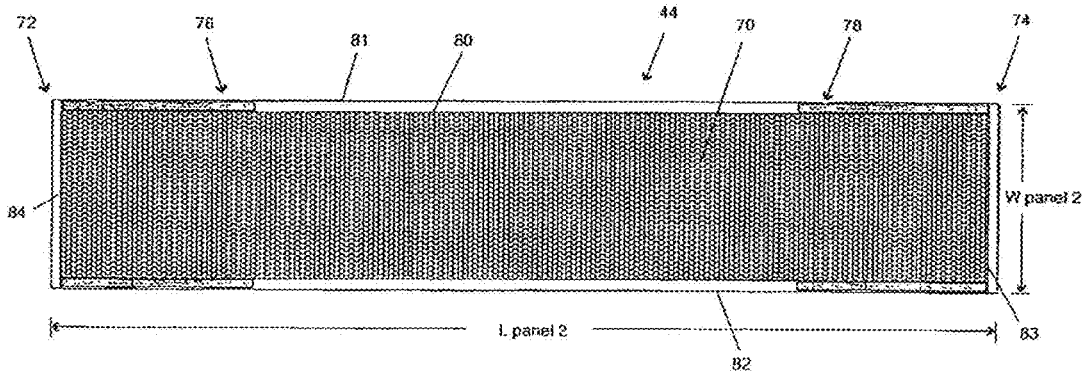
FIG. 2B

FIG. 2D
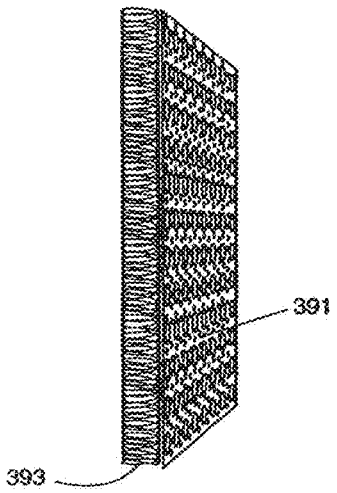
FIG. 2C
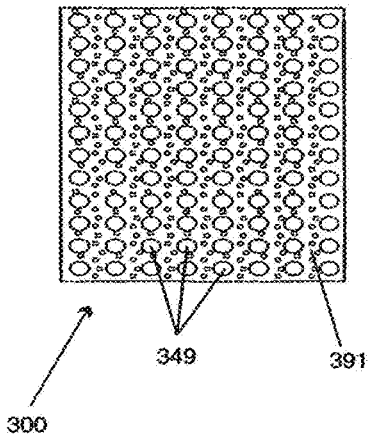
FIG. 2E
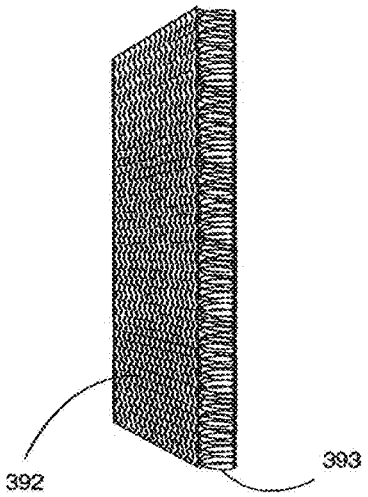
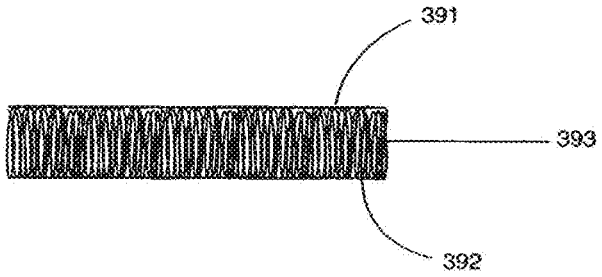
FIG. 2F

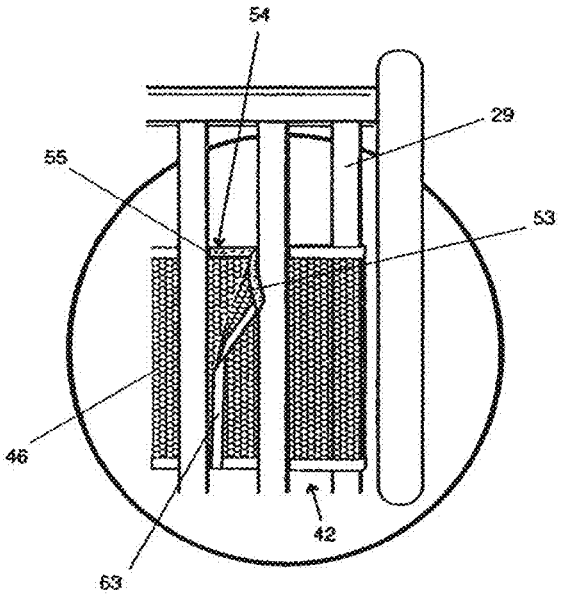
FIG. 3A
FIG. 3B
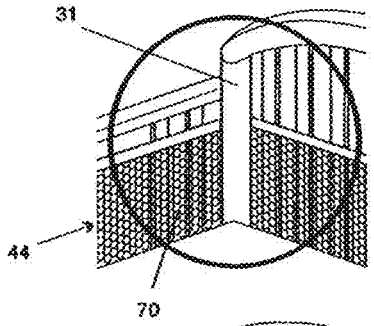
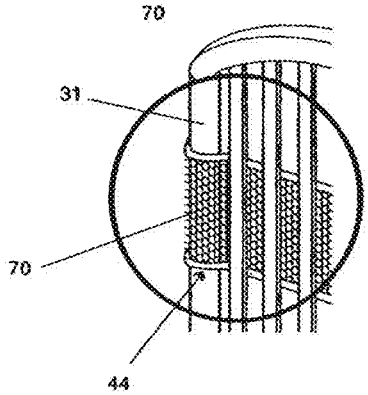
FIG. 3C

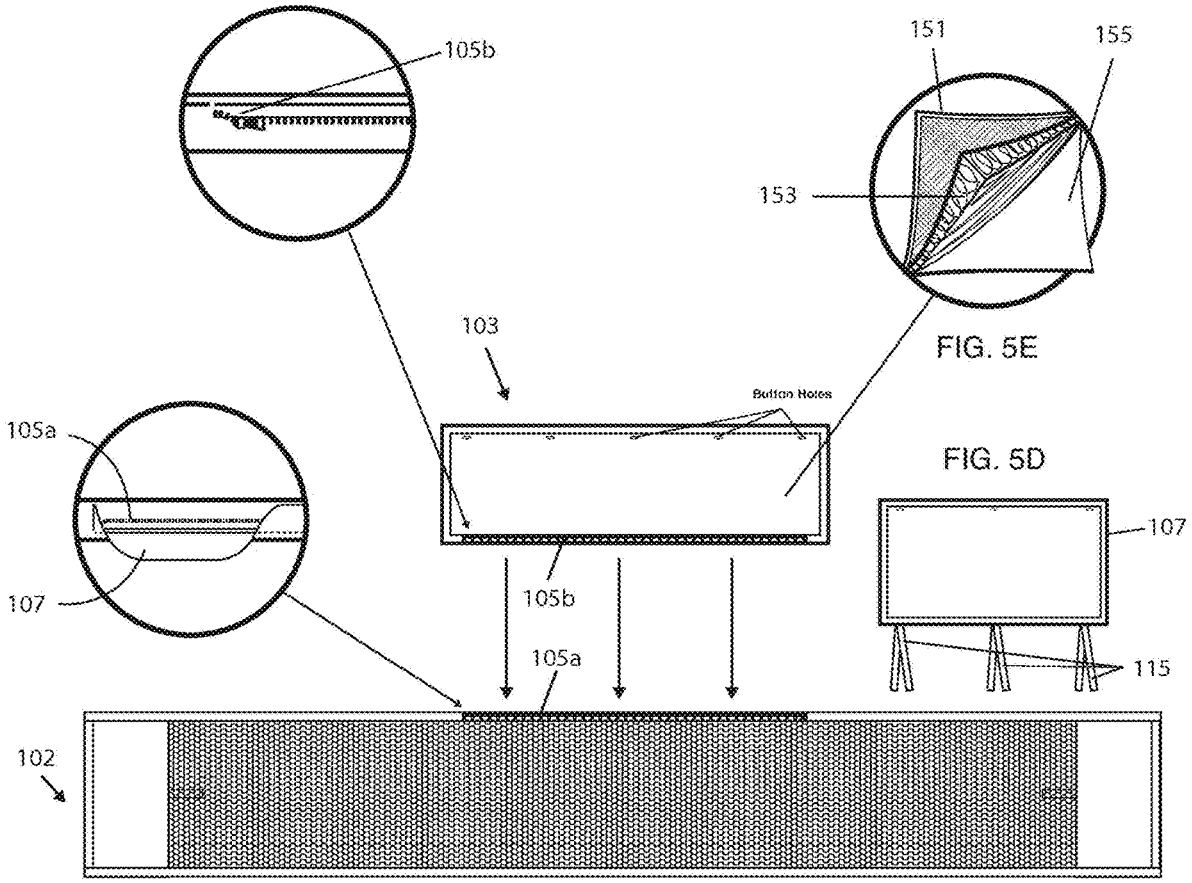
FIG. 5E
FIG. 5D
FIG. 5C
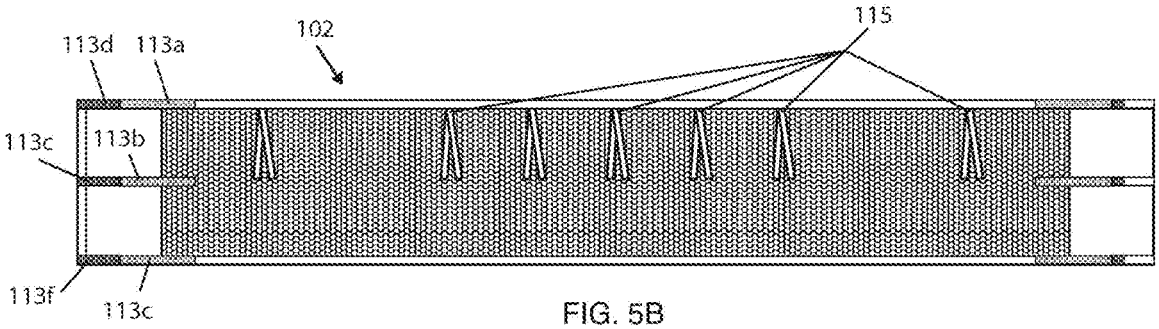
FIG. 5B

FIG. 6C
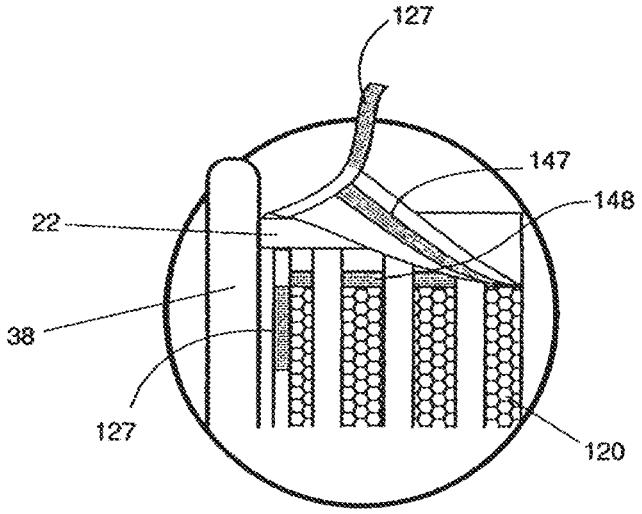
FIG. 6D
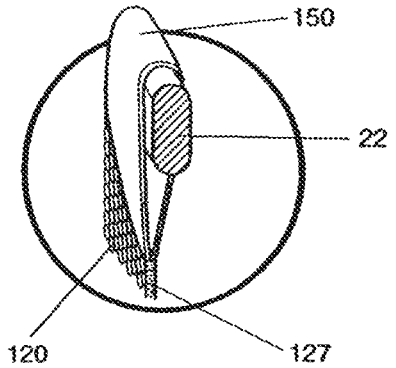
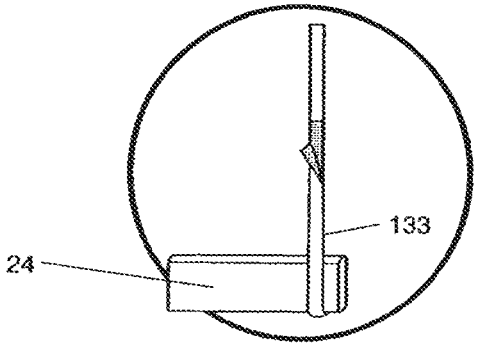
FIG. 6E
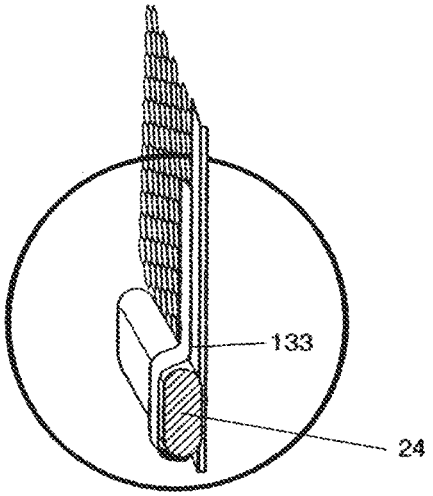
FIG. 6F

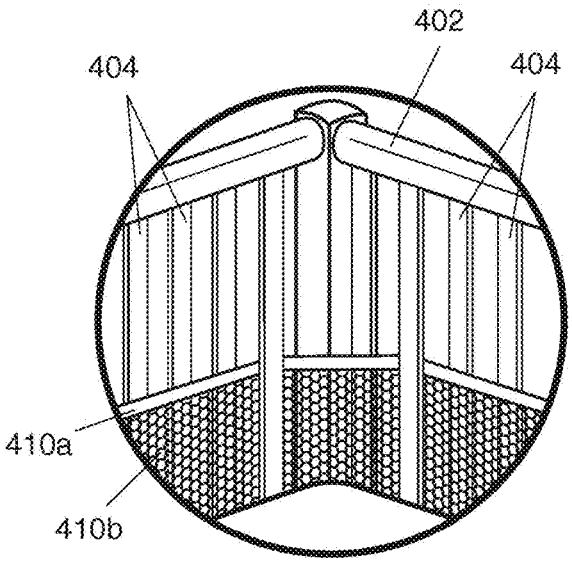
FIG. 15A
FIG. 15B
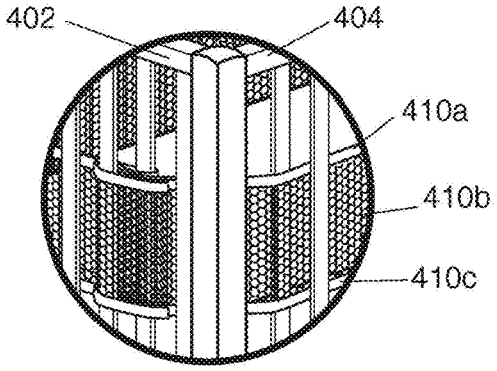
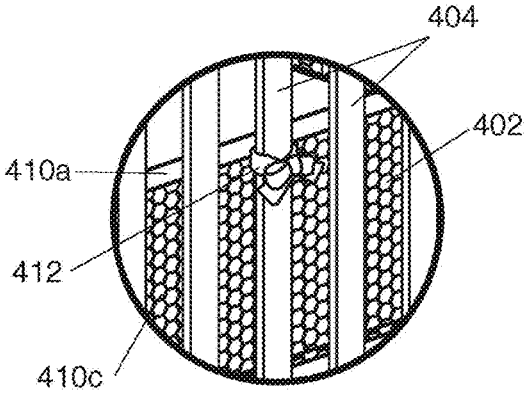
FIG. 15C

REVERSIBLE CRIB SHIELD SYSTEM

BACKGROUND OF THE INVENTION

The present invention relates to cribs and other usable objects (e.g., child usable objects). More particularly, the present invention pertains to crib attachments and other breathable apparatus that, for example, protect infants or young children from harm, e.g., crib attachments that prevent or protect infants or young children when in a crib from getting into one or more problematic situations, e.g., getting limbs extended and caught between crib slats or chewing on crib rails, siblings poking sharp objects into the crib, etc.

For example, conventional baby cribs include side rails that are made up of top and bottom horizontal bars interconnected by a series of spaced supports (e.g., vertical slats). Frequently, babies and toddlers, while sleeping or playing in their cribs, intentionally or accidentally extend their limbs out of the crib between the slats and have difficulty drawing them back into the crib. If this occurs when the child is sleeping, the extended limbs will remain uncovered and become cold, and the child will be ultimately awakened or harmed. Many cribs also have headboards and footboards (i.e., endboards) that are also made with spaced-apart supports and the baby may also extend its arms or legs out of the crib between these slats.

Although various types of apparatus have been used to prevent such problematic situations (e.g., extension of limbs outside of the crib through the spaced-apart supports), many of such apparatus exhibit their own problems. For example, as described herein, ventilation may be problematic (e.g., such as that leading up to and resulting in suffocation). For example, crib bumpers are widely used in cribs for protecting a child from injury caused by bodily impact of the child against the sides of the crib that define the interior boundary of the crib. However, in many cases, such bumpers do not allow for adequate ventilation within the crib and obstruct view of the child.

Infants usually breathe through the nasal passages. However, during crying or in the event their nasal passages are blocked, infants may breathe through their oral cavities. Mechanical resistance suffocation takes places when respiration is interrupted if these passages are both blocked externally by an object. When respiration is interrupted, $CO_2$ levels in the blood rise. The body's response to this elevation in $CO_2$ levels is to attempt more rigorous respiration. If the agent of suffocation is not removed, the incident may be fatal after two or three minutes. Further, the accumulation of $CO_2$ or other dangerous gases inside the crib or around the infant may be a possible cause of sudden infant death syndrome (SIDS). Existing crib apparatus, such as crib bumpers, tend to trap dangerous gases inside the crib. Further, such apparatus may block the passages of infants under certain circumstances.

Various types of other crib apparatus have been described and attempt to reduce one or more of the above problems. For example, such apparatus are described in U.S. Pat. No. 5,881,408 to Bashista et al., entitled "Mesh Crib Liner," issued 16 Mar. 1999; and U.S. Pat. No. 6,178,573 to Wagner et al., entitled "Ventilation Upgrade Kit for a Crib Bumper and Method of Using It."

SUMMARY OF THE INVENTION

The present invention, as described herein, addresses the problems described above and other problems of prior art systems and methods that will become apparent to one skilled in the art from the description below. For example, in a first aspect, a crib shield system, suitable for use with a crib, may include a mesh body portion; wherein the mesh body portion is comprised of at least a first mesh layer and a second mesh layer; wherein the first mesh layer and the second mesh layer are configured to be approximately the same height and length; wherein the first mesh layer and the second mesh layer are configured to be secured together to form a single panel; and wherein both the first mesh layer and second mesh layer comprise openings too small to permit an infant to insert a finger or toe there through.

In a second aspect, the invention may include a crib shield system, suitable for use with a crib, wherein the crib shield system comprises a mesh body portion, further comprising a first mesh-type material; wherein the mesh body portion comprises approximately 50% or more of a mesh-type material; wherein the first mesh-type material comprises a woven portion with a first size of openings too small to permit an infant to insert a finger or toe there through, and wherein the first mesh-type material comprises a woven portion with a second size of openings too small to permit an infant to insert a finger or toe there through.

In a third aspect, the invention may include a crib shield system, suitable for use with a crib, wherein the crib shield system comprises a mesh body portion, which further comprises a first mesh-type material; wherein the mesh-type material comprises a front layer, a middle layer, and a back layer; wherein the front layer, middle layer, and back layer of the mesh-type material are quilted together along at least two seams crossing the mesh body portion; wherein the at least two seams cross each other to create a pattern in the mesh body portion; and wherein the quilting anchors the middle layer to the front layer and back layer along the at least two seams.

In a fourth aspect, the invention may include a crib shield system, suitable for use with a crib, in which the crib shield system comprises a mesh body portion, further comprising a first mesh-type material; wherein the mesh-type material comprises a front layer, a middle layer, and a back layer, in which the front layer and back layer have different fabric weaves.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

FIG. 2A is a top view of one embodiment of a first side panel of the crib shield system shown in FIG. 1 in an unattached position laid flat, according to one example embodiment of the present invention.

FIG. 2B is a top view of one embodiment of a second side panel of the crib shield system shown in FIG. 1 in an unattached position laid flat, according to one example embodiment of the present invention.

FIGS. 2C-2F show details of one embodiment of a breathable mesh material that may be used in forming the side panels and the crib shield system shown in FIGS. 1 and 2, as well as other apparatus or objects described in other figures, according to one example embodiment of the present invention.

FIGS. 3A-3C illustrate the attachment of the first and second side panels shown in FIGS. 1 and 2 to a crib, according to one example embodiment of the present invention.

FIG. 5B shows a back side of a crib shield mesh, according to one example embodiment of the present invention.

FIG. 5C shows a front side and several magnified views of a side panel for use in a crib shield system, according to one example embodiment of the present invention.

FIG. 5D shows a side view of a second crib rail cover, according to one example embodiment of the present invention.

FIG. 5E is an illustration of a rail cover having multiple layers of fabric, according to one example embodiment of the present invention.

FIGS. 6A-6F show various illustrations for use in describing the attachment of the side panel shown in FIG. 5 to a crib side rail according to one example embodiment of the present invention.

FIGS. 15A-C show a detailed illustration of a crib liner, according to one example embodiment of the present invention.

DETAILED DESCRIPTION OF THE EMBODIMENTS

In general, the present invention is related to a crib liner that is breathable and provides for some protection from limbs getting entangled in crib slats. The crib liner can be made from any breathable material, such as mesh, and can be one or more panels for attachment to a crib. The crib liner may also be breathable primarily in the area of an infant's head and can be less breathable in other areas such as the borders of the liner. Since, in general, crib liners are removed from the crib as the infant gains the ability to sit or stand, the primary area of breathable concern is from the crib mattress surface up 4 or 5 inches in height, where the infant's head lies during sleeping.

Various embodiments of crib shield systems shall be described with reference to FIGS. 1-21 and the below description. Additional embodiments of the various breathable materials used within the crib shield systems shall be described with further reference to FIGS. 2C-2F, 5E, and 9-13. The particular features of the disclosed embodiments should not be limited to just those illustrated configurations. Instead, the various features disclosed within this disclosure may be combined to create exponentially more embodiments not explicitly illustrated within this disclosure. For example, the various fastener apparatus and configurations for attaching the crib liner to a crib disclosed within may be combined in far more configurations than illustrated within the confines of this disclosure. Further, some exemplary embodiments are illustrated as one panel embodiments while other exemplary embodiments are illustrated as two panel embodiments. It should be understood that the features of such illustrated one panel embodiments and illustrated two panel embodiments (e.g., size, shape, fastener arrangement, method of attaching to crib, etc.) may be interchanged and/or combined to form exponentially more embodiments not explicitly illustrated within this disclosure. As such, the claims should not be limited only to such exemplary illustrated embodiments. Additionally, breathable material includes breathable mesh material and breathable padded mesh material, but may also include alternate material(s) that have similar breathable and/or padding properties (e.g., the weave found in cotton sweaters, such as a corded cotton sweater, may be sufficiently padded and breathable).

Figure 1A:
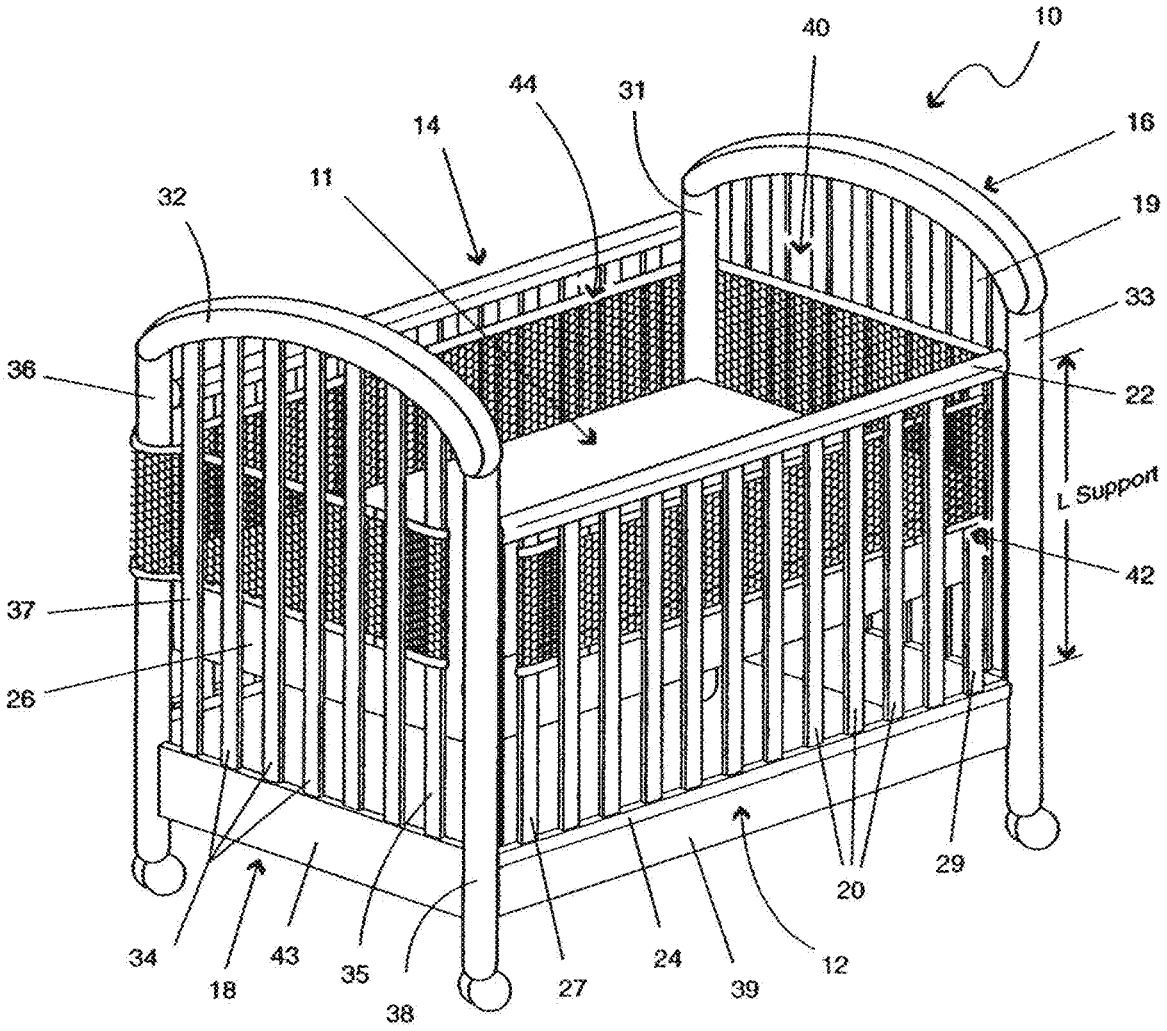
FIG. 1A shows a perspective view of one embodiment of a crib shield system attached to a crib, according to one example embodiment of the present invention.

FIG. 1A shows a conventional crib 10. The crib 10 can include two side rails 12, 14, and further, a footboard 16, and a headboard 18, referred to generically as endboards. The side rails 12, 14 extend between the footboard 16 and headboard 18 along a length thereof. The headboard 18, footboard 16, and side rails 12, 14 are connected and sized for receiving a mattress within an interior 11 of the crib 10. As illustrated, the crib is configured to receive a standard rectangular-shaped crib mattress.

Figure 4A:
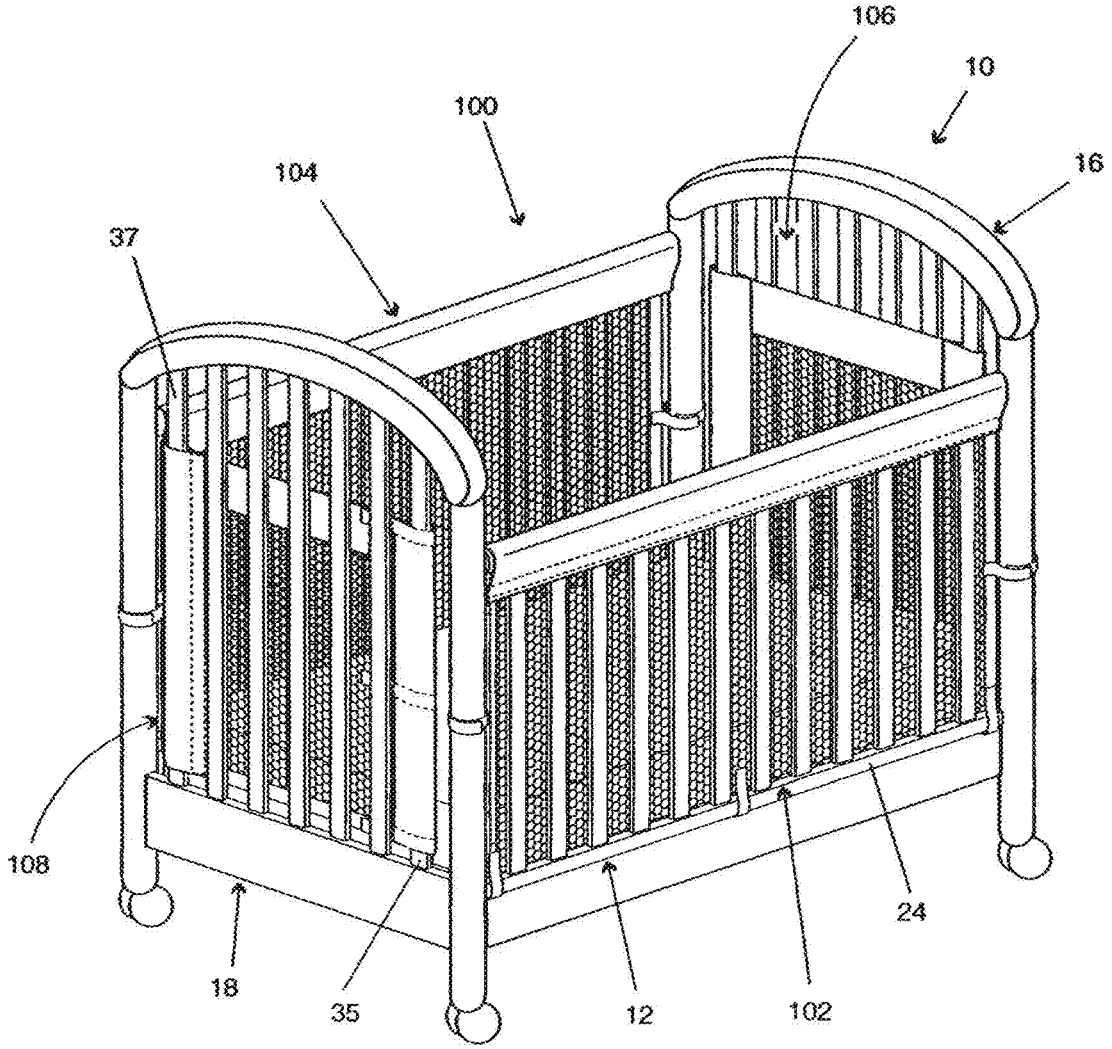
FIG. 4A shows a perspective view of a full crib shield system attached to a crib with the mattress of the crib in a lowered position, according to one example embodiment of the present invention.

Generally, the side rails 12, 14, footboard 16, and headboard 18 define an interior boundary extending proximate and around a periphery of the mattress 26 disposed within the crib 10. The mattress 26 is supported within the crib 10 by various structure not shown in FIG. 1A. For example, a bottom structural member may be supported at one or more positions about the interior boundary of the crib 10 (e.g., elements attached to corners 36, 38, 31, 33) or in any other fashion. In many conventional cribs 10, the mattress 26 and/or a supporting member therebelow may be raised and/or lowered. For example, as shown in FIG. 1A, the mattress 26 is in a raised state. On the other hand, as shown in FIG. 4A (to be described further herein), the mattress is shown in a lowered state. The lowered state is closer to the ground or floor upon which the crib 10 is positioned than the raised state. As such, the depth inside the crib is adjustable.

The side rail 12 generally includes a top bar 22 and a bottom bar 24 positioned approximately parallel to one another. A plurality of generally vertically-spaced side support elements 20 (i.e. slats) extend between the horizontal top bar 22 and horizontal bottom bar 24. Although less prevalent due to crib regulation, the side rail 12 in some older cribs is moveable from a raised state to a lowered state. For example, the moveable side rail 12 allows a user to lower the side rail 12 in order to have easier access to a child lying on mattress 26. As shown in FIG. 1A, side rail 12 can be raised or lowered relative to support structure element 39 and the remainder of the crib 10. The present invention allows for the side rail 12 to be moved from a lowered state to a raised state, or vice versa, even with the crib shield system 40 attached to the crib 10. Of course, typical cribs today do not have a moveable side rail, and the present invention also address these cribs. In addition, cribs may or may not have slats on one or more sides as the current trend in cribs is to have a crib that is convertible to a toddler bed, using one or more of the crib sides (or foot and head boards) as the foot and/or headboard of the toddler bed. In some cribs typical corner posts are not apparent. Therefore reference to a corner post herein does not strictly refer to a structural member at the corner of the crib and can also include where two sides meet.

Side rail 14 may be similarly configured like that of side rail 12. In other words, side rail 14 may be moveable from a lowered to a raised state, and vice versa. However, side rail 14 may also be in a stationary position fixedly attached to corners 36, 31. Likewise, side rail 12 may be moveable or in a fixed position. As moveable side rails are conventional configurations, no further description is provided with respect to the mechanisms for allowing such movement thereof. In addition, any of the sides of the crib may or may not include slats and the crib may or may not include corner posts. The crib shield systems described herein work with various mechanisms for moving side rails, e.g., side and bottom latch systems and gliding side mechanisms, fixed rails, rails with no slats, or cribs with no corner posts.

Headboard 18 of crib 10 includes an upper bar 32 (e.g., in a decorative curved shape) as well as a bottom horizontal element 43, each connected in a fixed position to corners 36, 38. In a similar manner to the side rails 12, 14, generally vertically-spaced support elements 34 extend between the top bar 32 and the horizontal element 43. It will be recognized that many cribs may or may not have spaced support elements that define a part of the footboard 16 or headboard 18. For example, the headboard and footboard may be solid materials as opposed to spaced-apart supports. The footboard 16 is configured in a manner like that of headboard 18 and includes corners 31, 33. Of course, in certain cribs there may or may not be corner posts, e.g. the convertible crib. Therefore the term "corner post" could simply be where two sides meet.

As shown in FIG. 1A, the plurality of spaced-apart side support elements 20, 34 of the side rails 12, 14 and the headboard and footboard 16, 18 are used to define the interior boundary extending proximate and around the periphery of the mattress 26 disposed within the crib 10. In one embodiment, and as shown in FIG. 1A, at least one panel is sized for covering at least a portion of the plurality of spaced-apart side support elements and configured to extend along at least a portion of the interior boundary. Of course, if there are no spaced-apart side support elements and there is a solid panel, the one panel would still cover the side. As is described herein, in one preferred embodiment, a significant amount of the panel is formed of a breathable material and the panel includes at least one fastening apparatus for securing at least one panel to the crib 10.

As used herein, the term mattress may include any structure disposed within crib 10 and upon which objects and/or human beings may be placed. In other words, mattress refers to any structure and not just a soft sleeping apparatus. For example, the crib could be configured into a playpen-type structure with a solid hard and/or flat bottom that is, for example, lowered very close to the floor. As such, and as used herein, a crib can be equated to and encompasses the various structures similar to a crib, such as those for containing a small child (e.g., playpens, portable cribs, convertible cribs, round cribs, or other structures including, for example, spaced-apart side supports which require an apparatus or system such as that described herein).

As further shown in FIG. 1A, crib shield system 40 is attached to crib 10 along a portion of the interior boundary of the crib 10 defined by the headboard 18, footboard 16, and side rails 12, 14. As shown in FIG. 1A, a first side panel 42 is attached to side rail 12. Further, a second side panel 44 is attached for covering side rail 14, footboard 16, and headboard 18. However, one skilled in the art will recognize that the second side panel 44 may also be configured to cover just the second side rail 14 and the footboard 16 (e.g., such as when the headboard 18 lacks vertical spaced-apart side support elements), or may cover just side rail 14 and headboard 18 (e.g., such as when footboard 16 lacks spaced-apart side support elements). In other words, the configuration of the second side panel 44 may differ depending upon the configuration of crib 10 upon which it is attached. Likewise, the configuration of the first side panel 42 may differ depending upon the configuration of crib 10 upon which it is attached. In addition, the attachments may be different if attaching to a rail with no slats, for example.

Figure 1B:
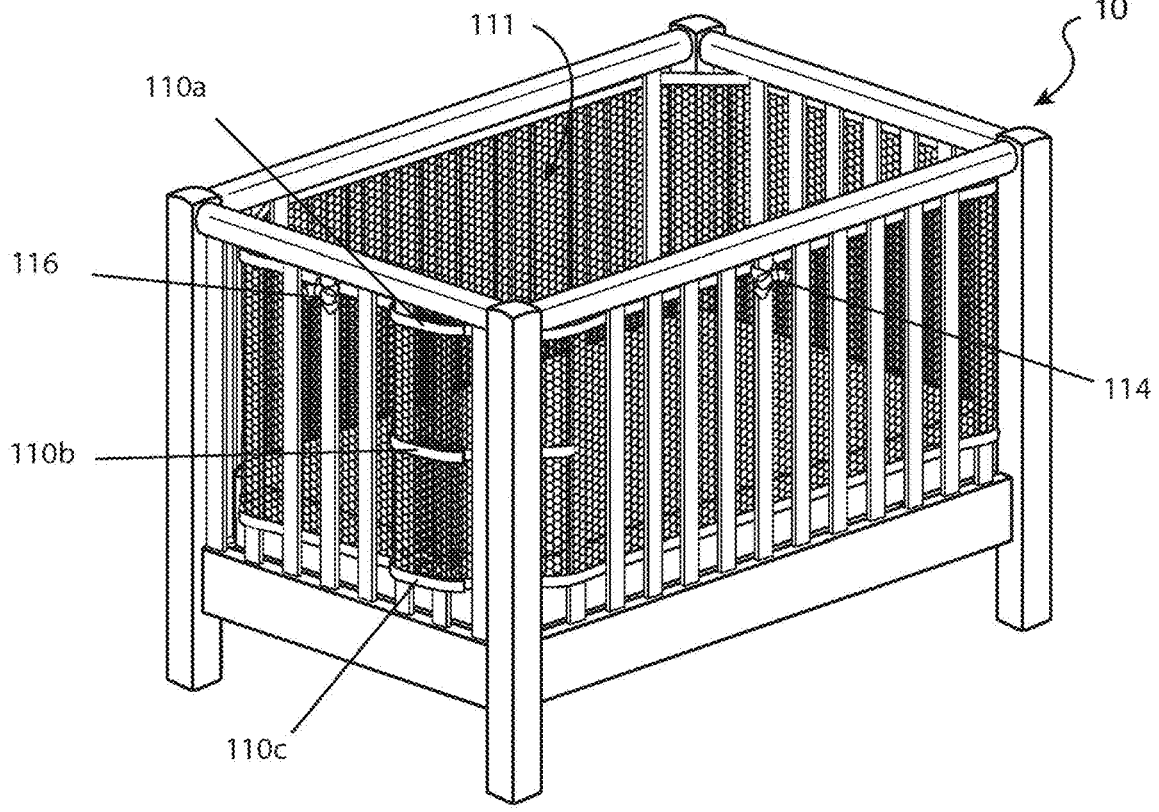
FIG. 1B shows a perspective view of one embodiment of a single-wrap crib shield system attached to a crib, according to one example embodiment of the present invention.

In another embodiment of the crib shield of FIG. 1A, the crib shield may extend nearly the full height of the crib. FIG. 1B shows a perspective view of one embodiment of a single-wrap crib shield system attached to a crib with a side rail of the crib in a raised or fixed state. A crib shield 111 may include wraps 110*a*, 110*b*, and 110*c* positioned at different vertical locations along the crib shield 111. The wraps 110*a*, 110*b*, and 110*c* may be Velcro, ties, snaps, zipper, or any other suitable fastener. The crib shield 111 may be fastened to the crib 10 through fasteners 114 and 116. The fasteners 114 and 116 may be located anywhere along the vertical height of the crib shield 111 or perimeter of the crib 10.

Figure 1C:
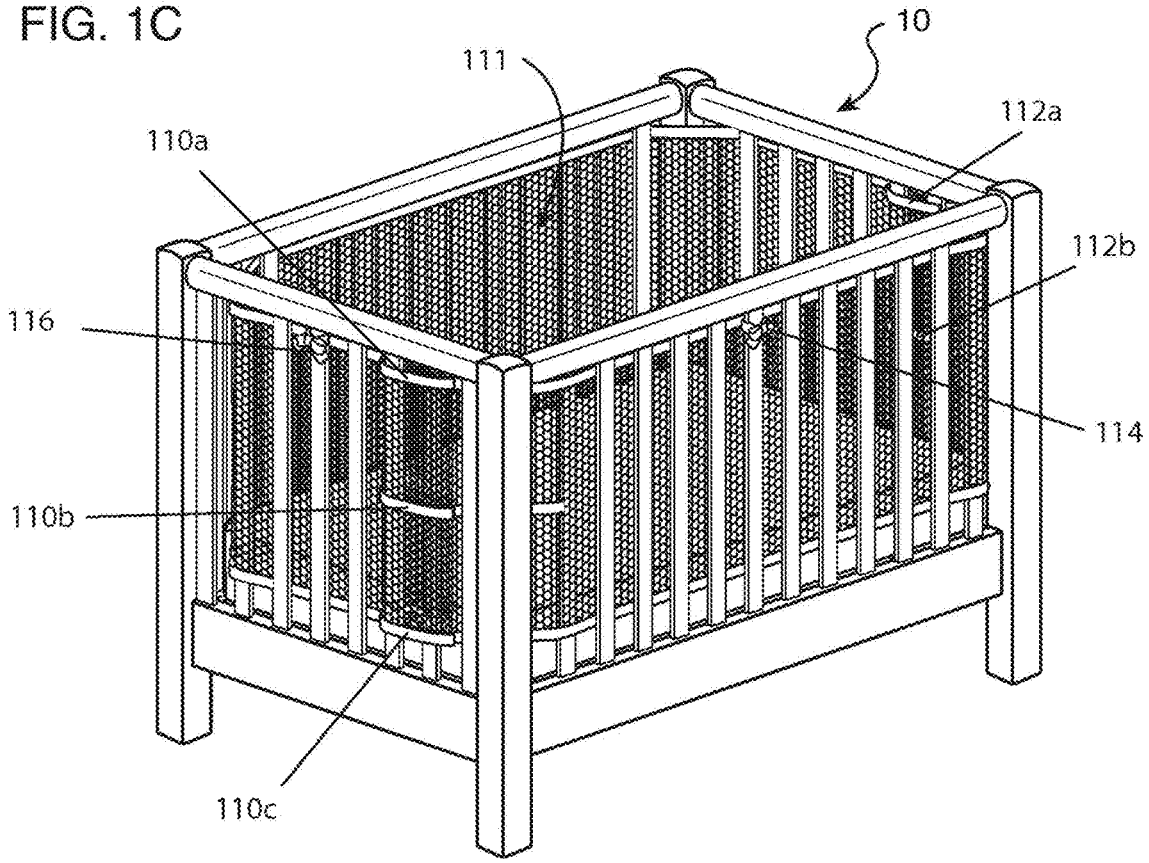
FIG. 1C shows a perspective view of one embodiment of a double-wrap crib shield system attached to a crib, according to one example embodiment of the present invention.

The crib shield of FIG. 1B illustrates a single wrap full height shield, but additional wraps may be used to secure the crib shield. FIG. 1C shows a perspective view of one embodiment of a double-wrap crib shield system attached to a crib with a side rail of the crib in a fixed or raised state. The crib shield 111 of FIG. 1C includes second wraps 112*a* and 112*b* located at different vertical heights along the crib shield 111.

Figure 1D:
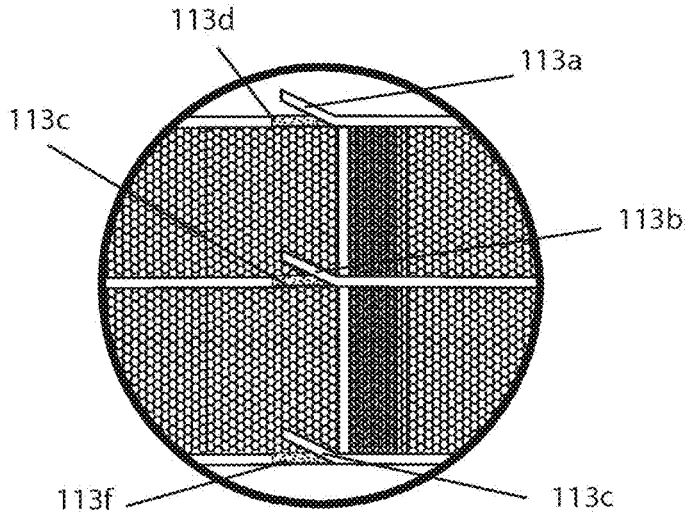
FIG. 1D shows a side view of one embodiment of a hook and loop velcro attachment, according to one example embodiment of the present invention.
Figure 1E:
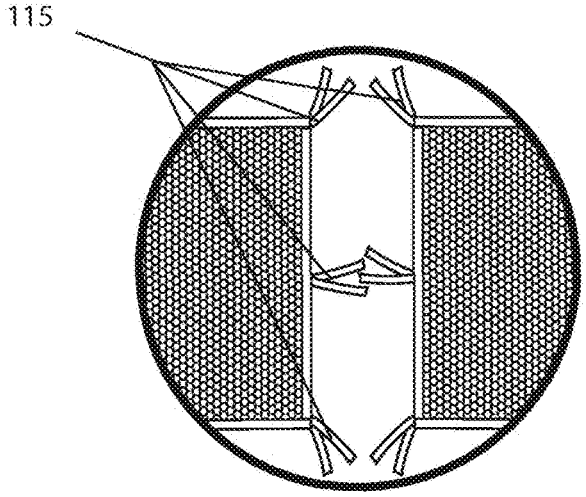
FIG. 1E shows a side view of one embodiment of tie attachments, according to one example embodiment of the present invention.
Figure 1F:
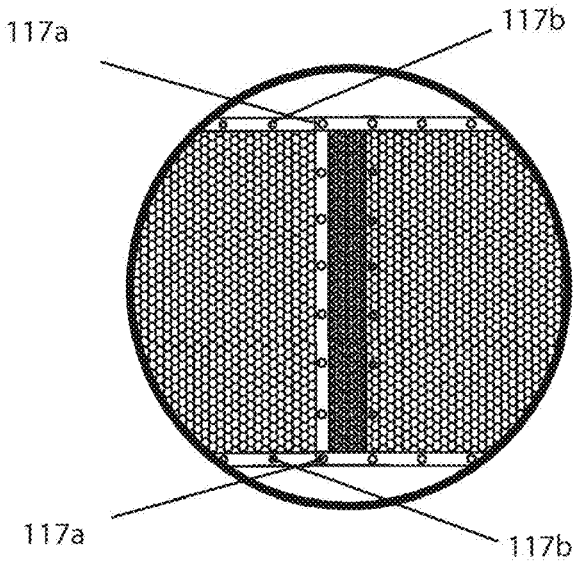
FIG. 1F shows a side view of one embodiment of snap attachments, according to one example embodiment of the present invention.

The various wrap types are illustrated in FIGS. 1D-1F. FIG. 1D shows a side view of one embodiment of a hook and loop Velcro attachment. Velcro 113*a*, 113*b*, and 113*c* located at different vertical positions may attach to Velcro receptors 113*d*, 113*e*, and 113*f*, respectively. FIG. 1E shows a side view of one embodiment of tie attachments. Ties 115 may be loose pieces of string located on ends of the crib shield or locations along the perimeter of the crib shield to allow an individual to tie one of the ties to another tie. FIG. 1F shows a side view of one embodiment of snap attachments. One side of the crib shield may include snap receptors 117*b* while another side of the crib shield may include snap attachments 117*a*. An individual snaps on the of the snap receptors 117*b* to a snap attachment 117*a* to secure the crib shield. A crib shield with snap attachments 117*a* and 117*b* allows an individual to custom size the crib shield by selecting where to couple a snap attachment to a snap receptor. Of course, one of ordinary skill would recognize there are multiple attachments available and multiple ways to attach the crib liner to the crib.

FIG. 2A shows the first side panel 42 in an unattached laid flat position. The first side panel 42 includes a body 46 formed of a mesh-type material that extends along the length (L panel 1) from a first end 48 of the first side panel 42 to a second end 50 of the first side panel 42. The length (L panel 1) of the first side panel 42 is sized for allowing attachment to the side rail 12 of crib 10. For example, the length (L panel 1) is slightly longer than the distance between spaced-apart side support elements 27, 29. In such a manner, the first side panel 42 can be wrapped about such side support elements 27, 29 and fastened thereto using hook and loop closures 52, 54, as is further described herein with reference to FIG. 3A.

In many embodiments, the body portion 46 has a width (e.g., W panel 1) that is less than a length (e.g., L support as shown in FIG. 1) of a vertical spaced support element 20 of the first side rail 12. In many embodiments, the width (e.g., W panel 1) is less than one-half the length (L support) of the vertical spaced side support element 20. In alternate embodiments, the crib liner is configured to be secured to a crib such that a portion of the liner (e.g., lower trim section) is located between the mattress and the crib, and as such, the breathable material of the liner exposed to an infant in the crib is not reduced by liner edging or trim sections composed of less breathable materials. In many embodiments, the crib liner is configured to provide breathable material along the side rails and endboards such that the head of an infant lying in the crib is exposed to breathable material. In preferred embodiments, the panel will have at least a four (4) inch width of breathable material, or greater, so that an infant resting against a side rail or endboard will only be exposed to the breathable material. It is less relevant if top and bottom boarders are breathable as they are not in the area of the infant's head. Therefore, it is possible that a liner be 12 or more inches in height as long as there is approximately 4 inches of breathable material in the area of the infant's head. In this example embodiment, the mesh may be only 33% of the total height of the liner, but it is substantially mesh near the infant's head where breathability matters most. In many embodiments, the breathable material will be configured to provide between five inches to eight inches or more of breathable material. It should be understood that the portion of breathable material may be adjusted based upon the average head size of an infant, which may be determined using available Center of Disease Control (CDC) data (e.g., average infant head circumference data). In most embodiments, the critical width of breathable material is the portion that extends from the top edge of the crib mattress and extends upward to the top of an average baby's head.

The first side panel 42 includes a first fastening apparatus 52 at the first end 48 of the first side panel 42 and a second fastening apparatus 54 at the second end 50 of the first side panel 42. Fastening apparatus 52 includes fastening portions 53, 55, such as hook and loop closures (e.g., Velcro). In one embodiment, fastening apparatus 54 is the same as fastening apparatus 52, however, such closure structures may also be different.

Various fastening apparatus may be used to attach the first side panel as well as the other panels as described herein to a crib. For example, various types of fastening apparatus may include hook and loop closures (e.g., Velcro), snaps, buttons/buttonholes, ties, straps, buckles, zippers, etc. Although hook and loop fasteners are preferable, any other closure or fastener apparatus suitable for attaching panels to crib 10 may be used.

In one embodiment, a finishing edge material 58 is provided along the periphery of the body portion 46. For example, as shown in FIG. 2A, a finishing edge material (e.g., a decorative material) may be used along edges 61-64. The finishing edge typically does not affect the breathability of the liner since it is not in close proximity to the infant's head.

FIG. 2B shows the second side panel 44 in an unattached laid flat position. The second side panel 44 includes a body portion 70 that extends along a length (L panel 2) from a first end 72 thereof to a second end 74 of the second side panel 44. The length (L panel 2) of the second side panel 44 is sized for allowing attachment to footboard 16 and headboard 18 and across side rail 14 of crib 10. For example, the length (L panel 2) is slightly longer than the combined lengths of the three sides of the crib 10 (i.e., the lengths of the footboard 16, headboard 18, and side rail 14). In such a manner, the second side panel 44 can be wrapped about support elements 19, 35 and fastened thereto using hook and loop closures 76, 78, as is further described herein. Further, the second side panel 44 has a width (W panel 2) that, at least in one embodiment, has substantially the same width as the width (W panel 1) of first panel 42.

Further, second side panel 44 includes fastening apparatus 76 at first end 72 of the second side panel 44 and fastening apparatus 78 at the second end 74 of the second panel 44. Such fastening apparatus 76, 78 are substantially similar to the hook and loop fasteners described with respect to first panel 42. Further, in a like manner, finishing edge material 80 may be used around the perimeter of the body portion 70 as shown by the finishing material 80 along edges 81-84.

The mesh-type material of the body portion 46 of first side panel 42 and body portion 70 of second side panel 44 may include any suitable material that provides breathable functionality such as a mesh type material. Breathable functionality refers to the ability of the material to allow air to move effectively therethrough. As used herein, when air is indicated as moving effectively through a material, it is meant that the material includes openings (e.g., mesh openings, open-framework, spaces between elements thereof, or even those that may not be visually perceivable openings but still allow a breathable function to occur) that do not impede air movement to an extent that would prevent a human being from breathing through (e.g., when a human's respiratory openings (e.g., nose/mouth) are in direct contact with a material) such a material in order to prevent suffocation and further that such openings are too small to permit an infant to insert a finger or toe therethrough. For example, such materials may include cotton, silk, polyester, nylon, modal/semi-cellulose based fabrics, etc.

In one embodiment, the mesh-type material may include a mesh available from Apex Mills, Inc. under the trade designation TA1 Mesh. However, other various similar mesh materials (e.g., mesh material having suitable openings) are available. A Suffocation Hazard Assessment was performed by RAM Consulting (Oak Brook, Ill.) (e.g., the Assessment is further described herein and for which protocol is available from RAM Consulting) on the TAI Mesh resulting in average readings of 1.6 cm $H_2O$ and, for an upper specification limit of 5 cm $H_2O$, a Z-value of 9.0 was obtained.

In most embodiments, the breathable material is a breathable mesh-type material 300 (e.g., a padded spacer mesh), such as that shown generally in FIGS. 2C-2F. The breathable material 300 includes openings 349 on a front substructure 391 thereof, as shown in top view of the material 300 of FIG. 2C. As shown in the cross-section of the breathable padded mesh material 300 in FIG. 2F, the material 300 further includes a back substructure 392. A pile substructure 393 may be integrated with or simply attached at certain locations and extend between the front and back substructures 391, 392. Each of the substructures (e.g., the front, back, and pile substructures) allows air to substantially move effectively therethrough. The material 300 is further shown in the perspective views of FIGS. 2D-2E. As illustrated, and in most embodiments, pile substructure 393 is generally linear (some wave and collapsing may occur) when extending between the front substructure 391 and back substructure 392. This linear configuration generally provides optimal air flow between the front and back substructures. However, in a few alternate embodiments, it may be beneficial to use a pile substructure 393 that is less than linear, whether lofted, matted, and/or bunched fibers. This may be done to improve padding properties, especially with padding that is sufficiently breathable. In a few alternate embodiments, the substructure 393 is attached only to the front substructure 391 or the back substructure 392.

Figure 2G:
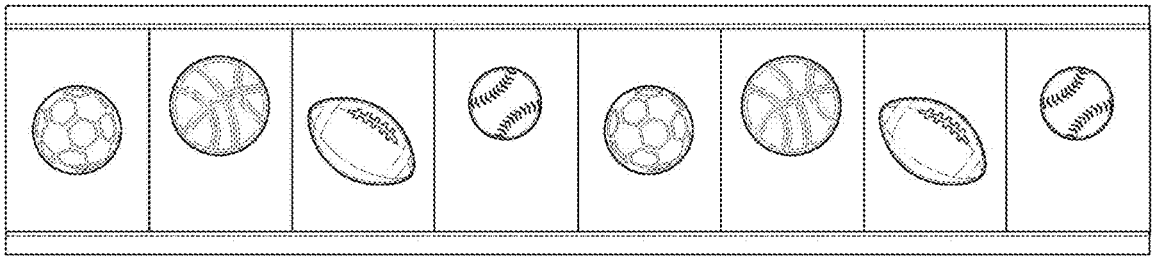
FIGS. 2G-H show illustrations of printed mesh designs for crib liners, according to one example embodiment of the present invention.
Figure 2H:
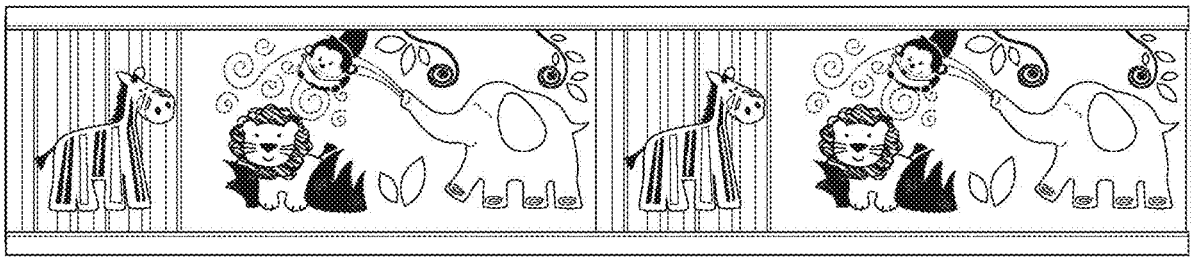

The meshes or other fabrics shown in FIGS. 2A-2F may include designs on the mesh. FIG. 2G shows an illustration of a printed mesh according to one embodiment of the disclosure. FIG. 2H shows an illustration of a printed mesh according to another embodiment of the disclosure.

It will be recognized that the thickness of the padded mesh material may vary, as well as for other materials described herein. For example, more padding may create a softer more plush effect with slightly different breathability/ventilation properties and more opaqueness (e.g., less light transmissive) whereas less padding may create more breathability and buoyancy with less opaqueness (e.g., more light transmissive). Preferably, the panels described herein are at least somewhat transparent such that at least motion of the child in the crib can be seen.

Yet further, the padded mesh material is collapsible. As such, when installed or uninstalled, should a child stand on it, the material will collapse. This reduces the risk of the mesh material being leverage to a climbing infant (unlike most conventional bumpers).

The breathable material may be a woven polymeric fiber mesh material that is integrated with or attached to a front and/or back substructure 391, 392. The front substructure 391 may include larger openings on the front substructure 391 than on the back substructure 392. In one example embodiment, the padded mesh material 300 may be integrated with or attached to the front and back substructures 391, 392 by weaving the fibers that are provided as part of the pile substructure 393 through the front and back substructure 391, 392 as shown in FIG. 2D-F. In another embodiment, the breathable material may be integrated by sewing, or otherwise attaching, the padded mesh material 300 between a front and back substructure or other substructures (not shown). That is, in this embodiment the padded mesh material is integrated by attaching to other materials, such as breathable materials or pad materials, to form a multi-layer structure (not shown). The multi-layer structure may be, for example, laminated or quilted.

In one embodiment, for example, the breathable padded mesh material 300 may include a padded spacer mesh available from Apex Mills, Inc. under the trade designation DNB27 Spacer Mesh. However, other various similar padded spacer mesh materials are available.

In another embodiment, the mesh-type material is a breathable padded mesh material in combination with one or more other material layers. For example, the breathable padded mesh material may be used in combination with one or more layers of other material adjacent to (e.g., one material laid flat against the other) either the front substructure and/or back substructure of the breathable padded mesh material. In various embodiments of such a combination, one or more layers of material may be used adjacent the front substructure, one or more layers of material may be used adjacent the back substructure, or one or more layers of material may be used adjacent the front substructure and the back substructure. For example, such additional layers may be layers of cotton material, knit jersey material, etc. Such additional material layers may provide additional benefits such as, for example, thermal properties with breathability.

Further, for example, the breathable material when used alone, or in combination with one or more additional layers, may be a breathable material (e.g., a breathable padded mesh material, such as a spacer mesh) that has a suffocation resistance level of less than about 15 cm H.sub.2O, and preferably less than about 5 cm $H_2O$. Such a suffocation resistance is determined according to the RAM Consulting Virtual Child Suffocation Hazard Assessment Model which is a physical model and testing methodology that quantitatively assesses the potential suffocation hazards posed by various types of materials. The details of this Model are available from RAM Consulting (Oak Brook, Ill.). Further, according to this Model, Z-values are determined that are statistical measurement tools that describe and predict product performance in relation to its specification limit (e.g., such as those described below). For example, the suffocation resistance limit of 5 cm H.sub.2O is an upper specification limit for materials or products that foreseeably are used and/or intended for young infants with high accessibility; and further, the suffocation resistance limit of about 15 cm $H_2O$ is an upper specification limit for other materials or products (e.g., those for toddlers). A Z-value of 4.0 or greater with the corresponding upper specification limit for each applicable testing technique is required for a product to be classified as a very low suffocation risk. The details regarding the determination of Z-values are available from RAM Consulting (Oak Brook, Ill.).

Suffocation Hazard Assessment was performed by RAM Consulting (Oak Brook, Ill.) on various configurations using the breathable padded mesh material available from Apex Mills, Inc. under the trade designation DNB27 Spacer Mesh.

1 Configuration 1: Single Layer of Padded Spacer Mesh Configuration 2: Layer 1: Padded Spacer Mesh Layer 2: Cotton Configuration 3: Layer 1: Knit Jersey Layer 2: Padded Spacer Mesh Layer 3: Cotton Configuration 4: Layer 1: Cotton Layer 2: Padded Spacer Mesh Layer 3: Cotton Configuration 5: Layer 1: Knit Jersey Layer 2: Padded Spacer Mesh Layer 3: Knit Jersey Configuration 6: Layer 1: Padded Spacer Mesh Layer 2: Flannel Fabrics tested: Knit Jersey Manufacturer: NATEX Content: 50% Polyester/50% Cotton Knit Jersey Style #: INT Cotton Manufacturer: SOUTHERN BELLE Content: 100% Cotton Style #: L93N67 Flannel Manufacturer: QUILTERS CORNER Content: 100% Cotton Style #: RN41324.

A screening was performed on all configurations in both a dry and wet state. The spacer padded mesh when layered with fabrics resulted in a satisfactory reading based on values in cm $H_2O$, wherein the specification upper limit for products young children are intended to lie on is equal to 5 cm $H_2O$ (e.g., mattress pads or items young infants are intended to have their face on) and wherein the specification for products young children are not intended to lie on is equal to 15 cm $H_2O$.

Four individual readings were performed with an average being determined. Dry state readings did not register, thus presenting very low hazard when the configurations were dry (i.e., under the 5 cm $H_2O$ specification limit). In the wet state (after application of 8 ml of sprayed on water), the average readings for the configurations were between 4.6 cm $H_2O$ and 6.2 cm $H_2O$.

For the individual single layer of spacer padded mesh, average readings of 1.7 cm $H_2O$ were taken. Further, for an upper specification limit of 5 cm $H_2O$, a Z-value of 9.5 was obtained.

As shown in FIG. 1A, the first side panel 42 is attached to first side rail 12 by wrapping first end 48 of the first spacer panel 42 about spaced side support element 27 and mating the hook and loop fastener portions 53, 55 as shown in FIG. 3A. The second end 50 of first spacer panel 42 is wrapped around side support element 29 and fastening apparatus 54 is used to hold the first side panel in place. For example, in one embodiment, the fastening apparatus 54 is attached to the side support element 27. Thereafter, the user pulls the panel taut across the plurality of spaced side support elements 20 by pulling on the second end 50 containing the fastening apparatus 54. Fastening apparatus 54 is the attached to support element 29 in such a manner to hold the taut panel in place. As such, the first side panel 42 is prevented from slipping after being attached to the spaced side support elements 27, 29. Of course other suitable methods of using the liner are contemplated.

In at least one embodiment, the first side panel 42 is configured to cover at least a portion of the first side rail 12 and to extend along the length of the crib 10. As used herein when a panel extends along the length of the crib 10, it will be recognized that the panel may not extend completely along the entire length, but may end proximate the headboard and footboard. For example, depending upon the fastening techniques used, the panel may be attached a short distance from the corners of the crib (see panel 42 as shown in FIG. 1A).

In a like manner, second side panel 44 is attached to the crib 10. For example, the second end 74 of the second side panel 44 is wrapped about spaced support element 35 of headboard 18. Fastening apparatus 78 (e.g., Velcro closures) is used to fasten the second end 74 about the support element 35.

Further, as shown in FIG. 1A, the body portion 70 of the second side panel 44 is fed to the inside of the crib 10 (e.g., to the inside portions of support elements 34) and thereafter fed to the outside of the crib 10 and around corner 36. The body portion 70 is continued to be fed back into the inside of the crib 10 (e.g., to the inside of the support elements of the second side rail 14) and thereafter fed once again to the outside of the crib 10 and around corner 31 (see FIGS. 3B-3C). Thereafter, the body portion 70 of the second side panel 44 is fed to the inside of the crib 10 once again at the footboard 16 and then wrapped around support element 19 of footboard 16 in a similar manner to the fastening of the second side panel 44 around support element 35 of headboard 18.

One will recognize that the second side panel may be attached to any number of different support elements, may be fed around and/or to the outside of one or more spaced support elements, and, as with the first side panel 42, is pulled taut prior to fastening to keep the second side panel 44 in position. Further, the weaving of the second side panel 44 around the corners and/or around one or more of the spaced support elements also assists in maintaining the second side panel 44 in position (e.g., in a position higher on the crib 10 when the mattress is raised relative to the floor and lower in the crib 10 when the mattress is lowered to the floor). In addition, any of the panels may be positioned such that a portion of the panel is below the upper surface of the mattress (e.g., a few centimeters below the surface along the side of the mattress) to assist in securing the crib and preventing arms and legs from going under the panel.

In another embodiment, the crib shield system may comprise a single side panel. As contemplated herein, the crib shield system or crib liner may be one or more panels and may or may not include a bottom panel. As shown in FIG. 1B, the crib 10 is substantially the same as that shown in FIG. 1A except that the side rail 12 is fixed and cannot be lowered or raised.

The single side panel 111, as shown in FIG. 1B, includes a body portion 70 that extends along a length (L panel 3) from a first end 72 thereof to a second end 74 of the single side panel 111, in a like manner with the second side panel 44 in FIG. 2B. The length (L panel 3) of the single side panel 111 may be sized for allowing attachment to footboard 16 and headboard 18 and across side rail 12 and 14 of crib 10. For example, the length (L panel 3) is slightly longer than the combined lengths of the four sides of the crib 10 (i.e., the lengths of the footboard 16, headboard 18, side rail 12, and side rail 14). In this embodiment, the single side panel 111 may be wrapped about support elements 35, installed along all four sides of the crib, and fastened to support elements 27 using hook and loop closures, as shown in FIG. 3A. Further, the single side panel 111 may have a width (W panel 3) that, at least in one embodiment, may have substantially the same width as the width (W panel 1) of first panel 42.

Further, as shown in FIGS. 1B-1C, single side panel 111 may include fastening apparatus 110*a-c* at first end of the single side panel 111 and fastening apparatus at the second end of the single side panel 111. Such fastening apparatuses 110*a-c* are substantially similar to the hook and loop fasteners described with respect to first panel 42. In one embodiment, finishing edge material 80 may be attached around the perimeter of the body portion 70 as shown by the finishing material 80 along edges 81-84.

In one embodiment as shown in FIG. 1B, the single side panel 111 may be attached to headboard 18 by wrapping first end 72 of the single side panel 111 about spaced side support element 35 and mating the hook and loop fastener portions 110*a-c*, as shown in FIG. 3A.

Further, as shown in FIG. 1B, the body portion 70 of the single side panel 111 may be fed to the inside of the crib 10 (e.g., to the inside portions of support elements 34) and thereafter fed to the outside of the crib 10 and inside corner 36. The body portion 70 may be continued to be fed back into the inside of the crib 10 (e.g., to the inside of the support elements of the second side rail 14) and thereafter fed once again to the outside of the crib 10 and inside corner 31 (see FIGS. 1B, 1C). Thereafter, the body portion 70 of the single side panel 111 may be fed to the outside of the crib 10 once again at the footboard 16 and then fed inside of corner 33 to the inside of the crib 10 (e.g., to the inside portions of support elements 20). Finally, the second end 74 of single side panel 111 may be wrapped around side support element 27 and fastening apparatus is used to hold the single side panel in place. Thereafter, the user may pull the panel taut across the plurality of spaced side support elements on all four sides of the crib by pulling on the second end 74 containing the fastening apparatus. Fastening apparatus may be attached to support element 27 in such a manner to hold the taut panel in place. The single side panel 111 may be deterred from slipping after being attached to the spaced side support elements 35, 27.

As shown in the exemplary embodiment of FIG. 4A, the crib 10 is substantially the same as that shown in FIGS. 1A-1C except that the mattress 26 is in a lowered position. However, the side rail 12 is a side rail that can be lowered or raised, as desired. Like the crib shield system 40 in FIG. 1A, the illustrated embodiment of crib shield system 100, shown in FIG. 4, allows the side rail 12 to be moved even with the crib shield system 100 attached to crib 10.

The illustrated embodiment of crib shield system 100 includes a first side panel 102 and a second side panel 104 for attachment to respective side rails 12, 14. Further, the crib shield system 100 includes a first end panel 106 for attachment to the footboard 16 and a second end panel 108 for attachment to the headboard 18.

Figure 4B:
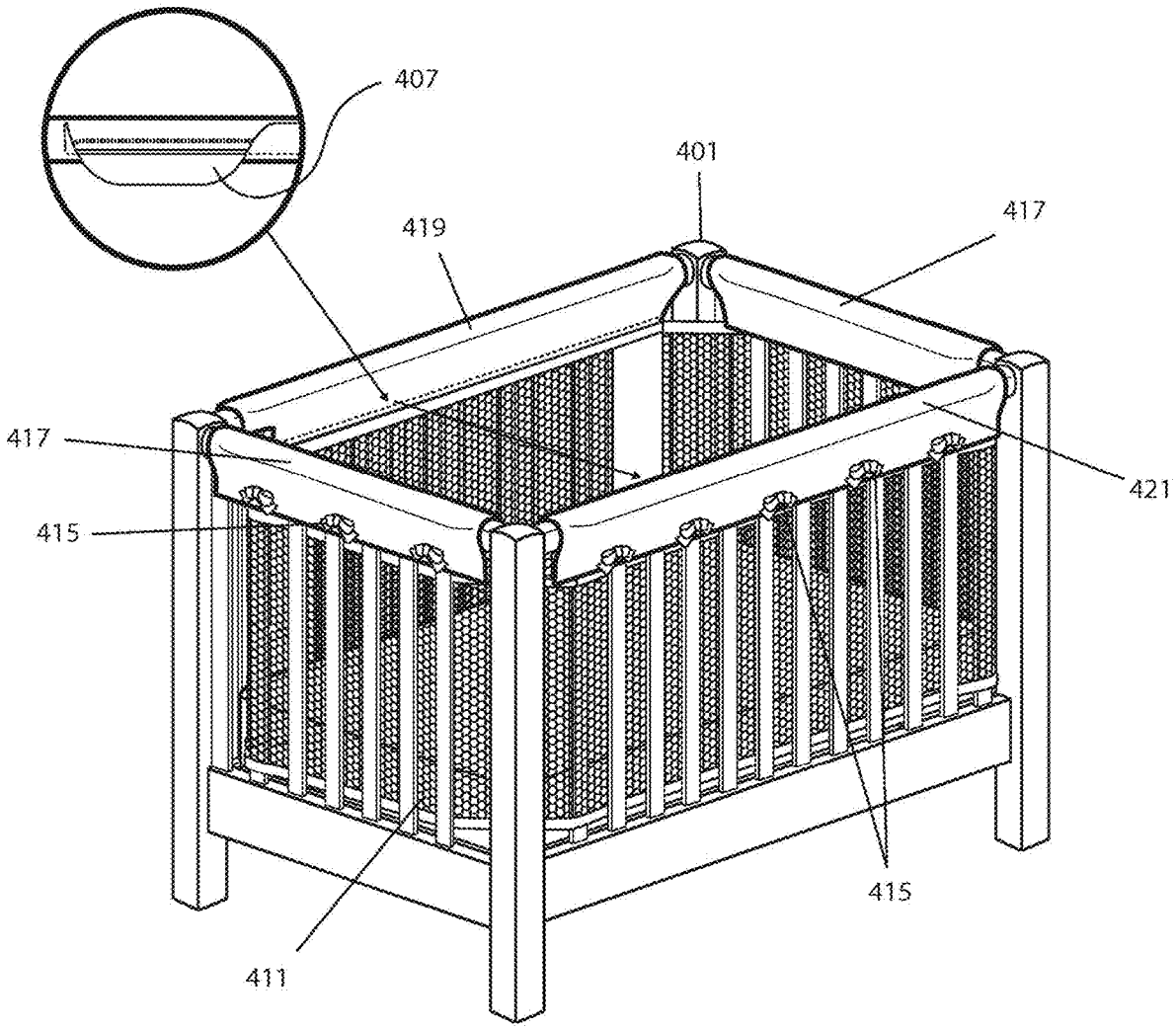
FIG. 4B shows a perspective view of a full crib shield system attached to a crib, according to another example embodiment of the present invention.

FIG. 4B shows a perspective view of another embodiment of a full crib shield system attached to a crib. A mesh 411 extends around a crib 401. A number of ties 415 attach side rail covers 417, a back rail cover 419, and a front rail cover 421 to the mesh 411. A hidden zipper (not shown) may attach a front side of the rail covers 417, 419, and 421 to the mesh 411. The hidden zipper may be concealed by a flap 407, such as in a gusset pocket. In some embodiments, the rail covers 417, 419, and 421 may be available as upgrades to a basic mesh crib liner 411. The rail covers 417, 419, and 421 may be a solid color or include patterns and be made of washable material with quick drying capability.

FIG. 5 shows a first side panel 102 of an exemplary crib shield system 100 in an unattached laid flat position. The first side panel 102 includes a body portion 120 formed of a mesh-type material. In one embodiment, the mesh-type material is an open framework material that includes openings too small to permit an infant to insert a finger or toe therethrough. However, any breathable material known to a person of ordinary skill in the art may be used, such as the breathable materials described herein.

The body portion 120 extends along a length (L panel 1) extending from a first end 122 of the first side panel 102 to a second end 124 thereof. Further, the laid flat first side panel 102 has a width (W panel 1) that is sized to cover at least a substantial portion of side rail 12.

As used herein, when referring to the covering of a substantial portion of a side rail (or headboard or footboard), at least two-thirds of the side rail 12 is covered. However, the first side panel may cover less than a substantial portion. For example, the first side panel may cover just a majority of the entire side rail 12.

The first side panel 102 further includes a fastening apparatus 126 that extends along an entire edge 144 of the side panel 102 for use in attaching the side panel 102 to the top bar 22 of the side rail 12, as is shown in further detail in FIGS. 6A-6D. The fastening apparatus 126, at least in one embodiment, includes first and second fastening portions 147, 148 that are both for mating with one another in order to hold the first side panel 102 in a fixed position relative to side rail 12.

In various embodiments, the fastening apparatus 126 may be a series of straps or ties intermittently disposed along the edge 144 of the side panel 102 for use in attaching the side panel 102 to the top bar 22 of the side rail 12, as is shown in further detail in FIGS. 18-20 below. Each of the straps or ties of fastening apparatus 126, at least in one embodiment, includes first and second fastening portions 147, 148 that are both for mating with one another in order to hold the first side panel 102 in a fixed position relative to side rail 12.

Figure 6A:
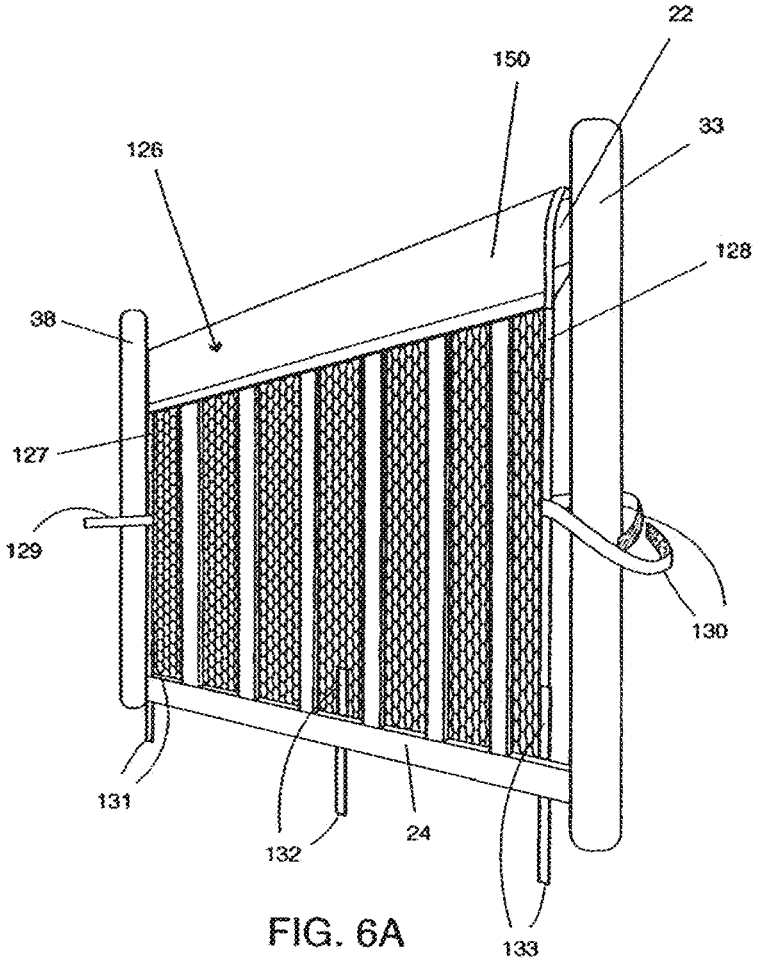

As shown in FIG. 6A, the exemplary fastening apparatus 126 may include a padded portion 150 that is wrapped around top rail 22 such that first and second fastening portions 147, 148 can be placed in contact with one another. As a result, the padded portion 150 covers the top bar 22 of the side rail 12. With use of the fastening apparatus 126 that extends along the entire edge 148 of the first side panel 102, the first side panel 102 can be fixed in a stable position with respect to side rail 12. For example, the first side panel 102 can be fixedly positioned to prevent movement thereof relative to the side rail 12 using one or more other various fastening apparatus.

In another embodiment, the padded portion 150 may be removably attached to the fastening apparatus 126. For example, the padded portion 150 may comprise a strip of padded material with one fastening side, the fastening side designed to be removably attached to the fastening apparatus 126 using hook and loop fasteners, snaps, zippers, or other appropriate fastening apparatus. The padded material may be any suitable material, not just the aforementioned mesh-type material.

Figure 5A:
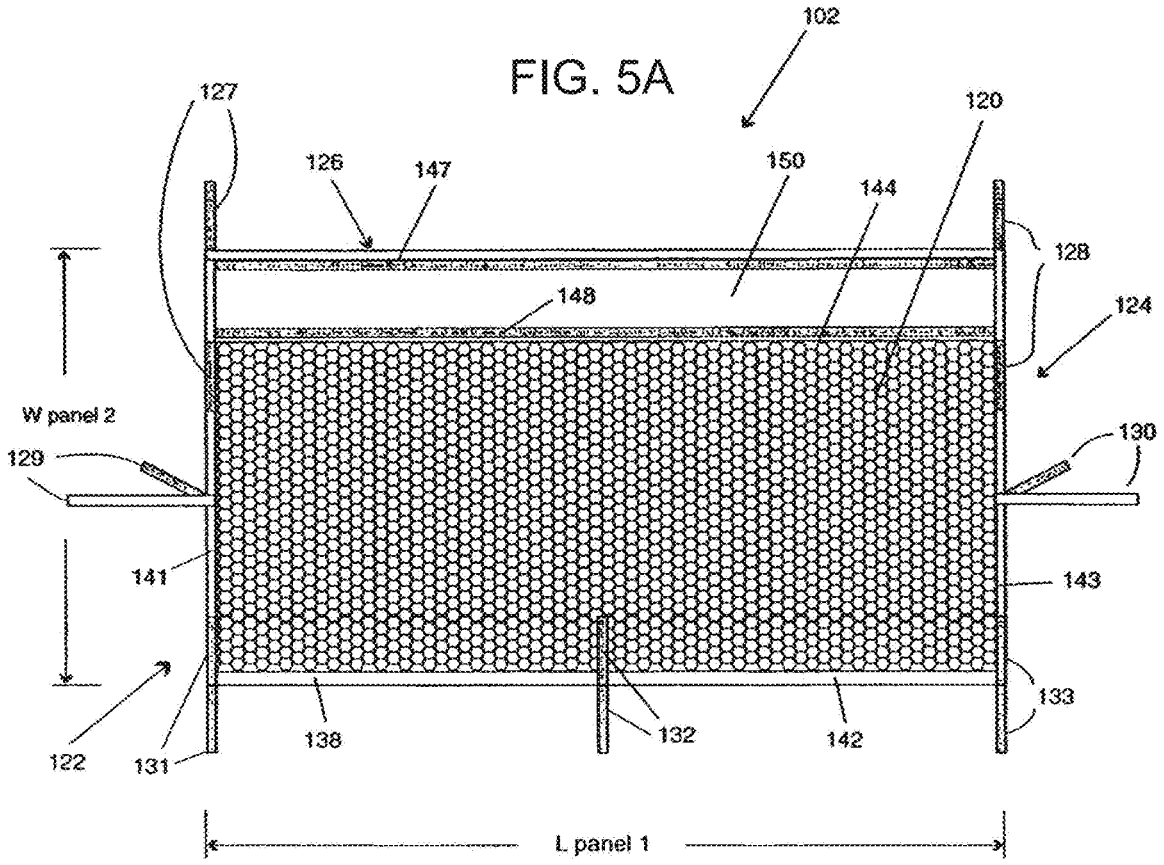
FIG. 5A shows a top view of a side panel for use in the full crib shield system shown in FIG. 4A in an unattached position laid flat, according to one example embodiment of the present invention.

For example, as shown in FIG. 5A, closures 127-128 provide for additional affixing functionality about the top bar 22 of the crib 10. In addition, closures 129-130 assist in affixing the first side panel 102 to respective corners 38, 33. Yet further, for example, a plurality of closures 131-133, located opposite the edge 144 can be used to attach the first side panel 102 to bottom bar 24 of the side rail 12 such that the panel 102 is held in a taut manner across the plurality of support elements 20.

FIG. 5B shows a back side of a crib shield mesh according to the present invention. A crib shield 102 may include one or more ties 115 along a top end of the crib shield 102. The ties 115 may allow connection of the crib shield 102 with a rail cover described below with reference to FIG. 5D. Although not shown, the ties 115 may also be coupled to a bottom end of the crib shield 102. The crib shield 102 may also include a number of Velcro loops 113 including Velcro attachments 113*a*, 113*b*, and 113*c*, and Velcro receptors 113*d*, 113*e*, and 113*f*. The receptors 113*d*, 113*e*, and 113*f* may loop around a support structure (not shown), such as a crib, and hook around to couple to the attachments 113*a*, 113*b*, and 113*c*.

FIG. 5C shows a front side and several magnified views of a side panel for use in a crib shield system according to the present invention. The crib shield 102 of FIG. 5C may illustrate a side of the crib shield 102 facing an inside of a crib. In one embodiment, the crib shield 102 may have a size of approximately 128 inches by approximately 19.5 inches, although various sizes may be configured to fit different crib sizes and shapes. A fastener 105*a* may couple the crib shield 102 to a front/back crib rail cover 103 through a fastener 105*b*. The cover 103 may have a size of approximately 46 inches by approximately 14 inches. The fastener 105*a* and 105*b* may be a half of a zipper and the zipper pull located on one or the other of fastener 105*a* and 105*b*. For example, the rail cover 103 may include the zipper pull 105*b*, such as a dual separating zipper, which may be opened or closed from either end. A flap 107 may extend over the fastener 105*a* to conceal the zipper. Although a zipper is illustrated connecting the crib shield 102 and the rail cover 103, other fasteners such as buttons, snaps, and ties are possible. A second rail cover may be used for sides of a crib. FIG. 5D shows a side view of a second crib rail cover. The cover 107 includes ties 115 for coupling to the ties 115 of the crib shield 102 illustrated in FIG. 5B.

The rail cover 103 may include multiple layers of material. FIG. 5E is an illustration of a rail cover having multiple layers of fabric. For example, the cover 103 may include an outer layer 151 such as mesh fabric, a middle layer 153 such as a padded filler, and a bottom layer 155 such as a waterproof layer, allergen-blocking layer, or other fabric. The cover 107 may have a size of approximately 27 inches by approximately 14 inches.

One skilled in the art will recognize that many types of closures may be used to provide the attachment functionality, such as those described previously herein with respect to crib shield system 40. In one particular embodiment, all of the closures are provided with hook and loop fasteners (e.g., Velcro fasteners). In such a manner, no ties are necessary, which eliminate additional material that could be grabbed by a small child and pulled upon.

FIGS. 6A-6D show further detail illustrating the attachment of the first side panel 102 to the crib 10. FIG. 6A shows the fastening apparatus 126 wrapped around the top bar 22 of the crib 10 and, in particular, a closure 130 wrapped around post 33 but not yet in a closed position.

Figure 6B:
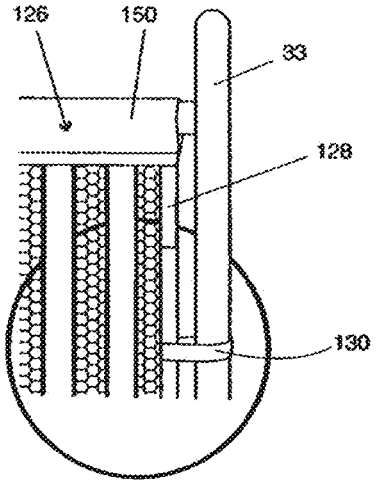

FIG. 6B shows the closure 130 in a wrapped around configuration and closed (e.g., the hook and loop fasteners in direct contact with one another and providing attachment to corner post 33).

FIG. 6C shows the fastening apparatus 126 in further detail, including fastening portions 147-148 and closure 127 in a partially unattached configuration.

FIG. 6D shows a cross-section view of the top bar 22 having the padded rail cover portion 150 wrapped therearound.

FIG. 6E shows one of the bottom closure strap attachments 133 used to wrap around bottom bar 24. The strap attachment 133 is shown in a partially closed position with a part of the hook and loop fasteners in direct contact.

FIG. 6F shows a cross-section of the bottom bar 24 having strap attachment closure 133 wrapped therearound and in a fastened configuration.

It will be readily understood that second side panel 104 is substantially similar to that of first side panel 102. In addition, the attachment of second side panel 104 to side rail 14 is performed in substantially the same manner as the attachment of first side panel 102 to side rail 12 of crib 10.

Figure 7A:
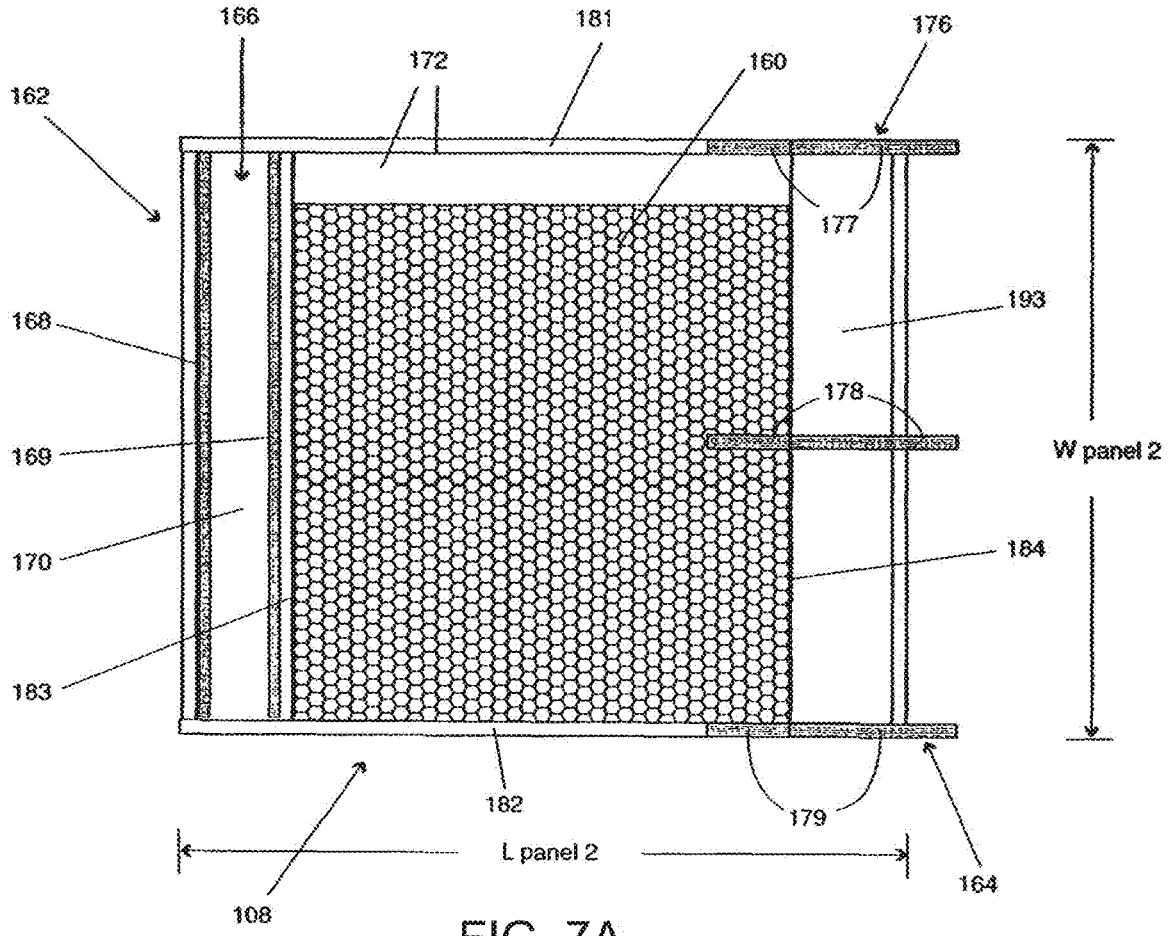
FIG. 7A shows a top view of an end panel for use in the full crib shield system shown in FIG. 4A in an unattached position laid flat, according to one example embodiment of the present invention.

FIG. 7A shows an exemplary end panel 108 in an unattached laid flat position. The end panel 108 includes a body portion 160 of mesh-type material like that described with respect to first side panel 102 which extends along a length (L panel 2) from a first end 162 to a second end 164 of the end panel 108. Further, the end panel 108 has a width (W panel 2) that along with length (L panel 2) is sized to cover a substantial portion of headboard 18. The end panel 108 includes fastening apparatus 166, for example, along the entire edge 183 of the body portion 160 for use in attachment of the end panel 108 to a support element 37 of the headboard 18. The fastening apparatus 166 includes fastener portions 168-169 and a body portion 170. The body portion 170 is wrapped around the support element 37, as shown in further detail in FIG. 8, with the fastener portions 168-169 placed in direct contact with one another to provide attachment of the end panel 108 to the headboard 118. The fastener portions 168-169 are preferably hook and loop fasteners to provide a consistent closure along the entire width (W panel 2).

At least one other fastening apparatus, such as fastening apparatus 176, are provided at one or more positions along an edge 184 opposite edge 183 to allow a user to pull the panel taut across the headboard 118 when fastening apparatus 166 has been attached to support element 37. Such fastening apparatus 176 can be thereafter used to secure the end panel 108 around support element 35 and maintain the end panel 108 in a taut position adjacent the support elements 34. In one embodiment, the fastening apparatus 176 includes hook and loop fasteners 177-179 (e.g., Velcro closures) positioned along edge 184 using a body of material 193 that can be wrapped about support element 35.

Figure 7C:
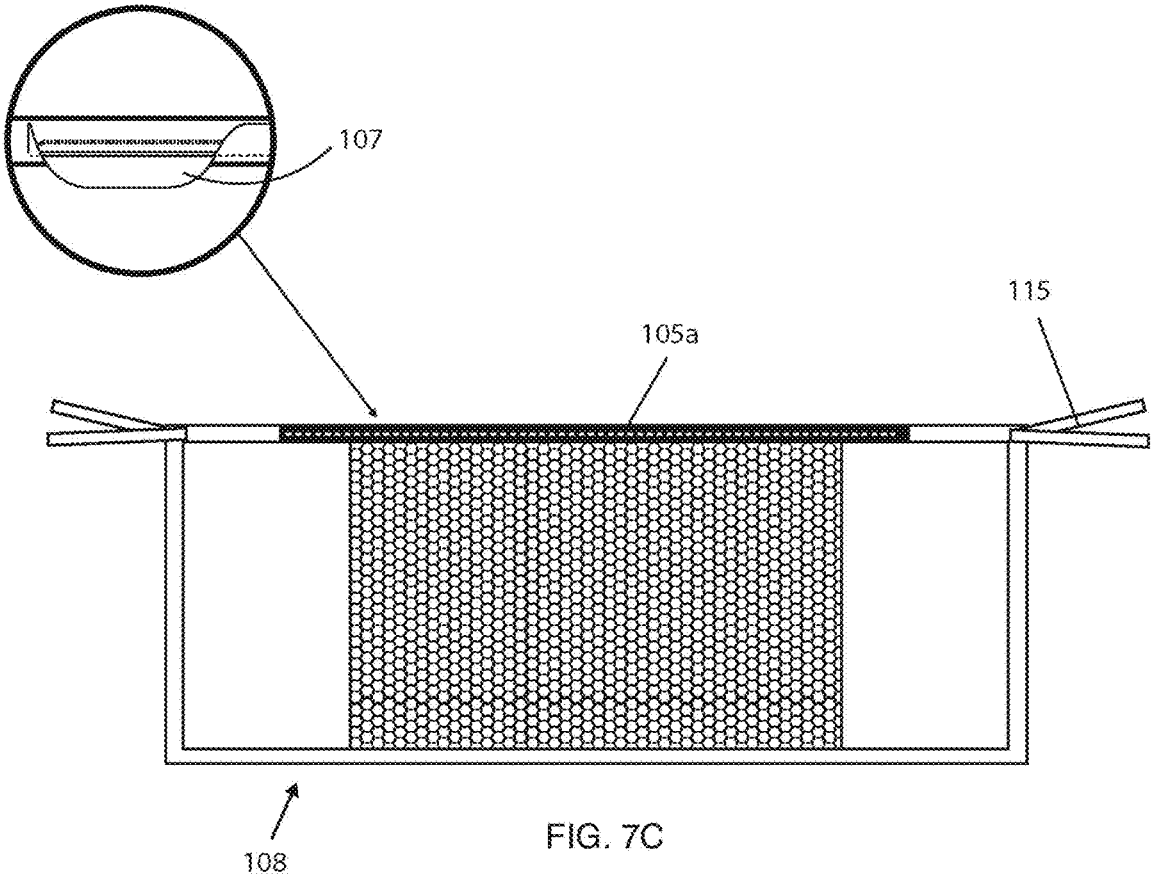
FIG. 7C shows a front side of a back panel wrap for attaching to a rail cover, according to one example embodiment of the present invention.
Figure 7B:
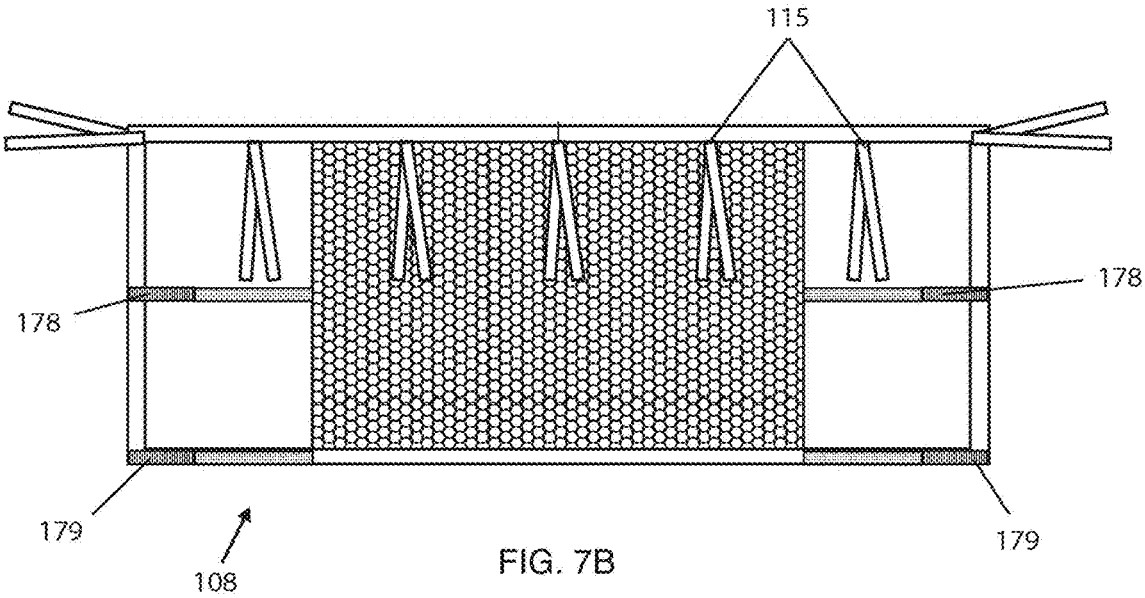
FIG. 7B shows a back side of a back panel wrap for attaching to a rail cover, according to one example embodiment of the present invention.

FIG. 7B shows a back side of a back panel wrap for attaching to a rail cover according to the present invention. The short back panel 108 may include a number of ties 115 for coupling to a rail cover. The short back panel 108 may also include a number of hook and loop fasteners 178 and 179.

FIG. 7C shows a front side of a back panel wrap for attaching to rail cover according to the present invention. The front side of the short back panel 108 may face an inside of a crib. The back panel 108 may include a receptor 105*a* for coupling to a rail cover. The receptor 105*a* may be, for example, one half of a zipper or one half of a zipper with a zipper pull. The flap 107 may conceal the receptor 105*a*. The back panel 108 may have a size of approximately 56 inches by approximately 22 inches.

Figure 8:
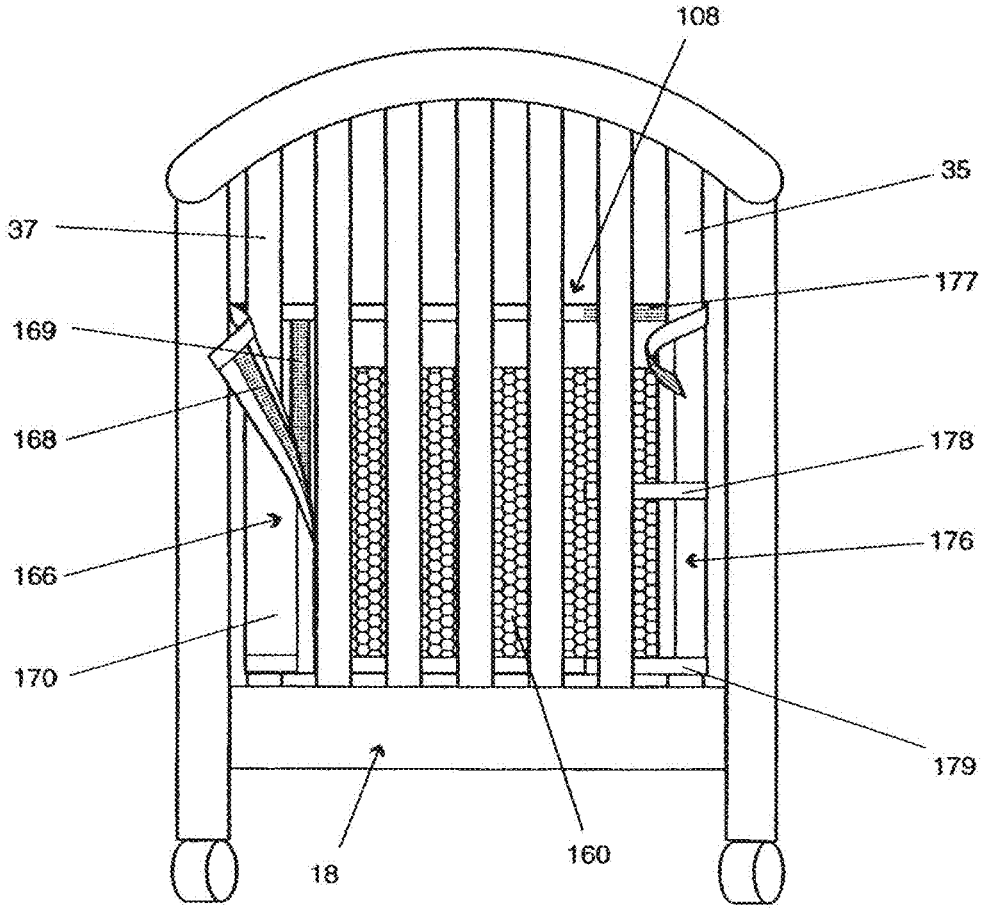
FIG. 8 shows an illustration for attachment of the end panel shown generally in FIG. 7A to a headboard or footboard of a crib, according to one example embodiment of the present invention.

FIG. 8 shows an illustration of attaching the end panel 108 to headboard 118. For example, as shown therein, closure 177 is in an unattached configuration, whereas closures 178, 179 are in a fastened configuration. Likewise, fastening apparatus 166 along the first end 162 of the end panel 108 is shown in a partially fastened configuration.

It will be readily understood that a second end panel 106 may be substantially similar to that of first end panel 108. In addition, the attachment of second end panel 106 to the footboard 16 is performed in substantially the same manner as the attachment of first end panel 108 to headboard 18 of crib 10.

Both the side panel 102 and the end panel 108 may be provided with associated finishing material for functional or decorative purposes (e.g., to prevent the fraying of mesh material of body portion 120, to provide further padding, etc.). For example, as shown in FIG. 5A, finishing edge material 138 may be used along edges 141-143. Likewise, as shown in FIG. 7A, finishing material 172 may be used along edges 181-182. Further, it will be recognized by one skilled in the art that various types of materials may be used along the edges and in combination with various fastening apparatus for attaching the panels to the crib 10. However, preferably, the exposed portions of the panels (e.g., exposed to a child in the crib) are formed of the mesh-type material, while the finishing edge material may be less breathable.

Figure 20A:
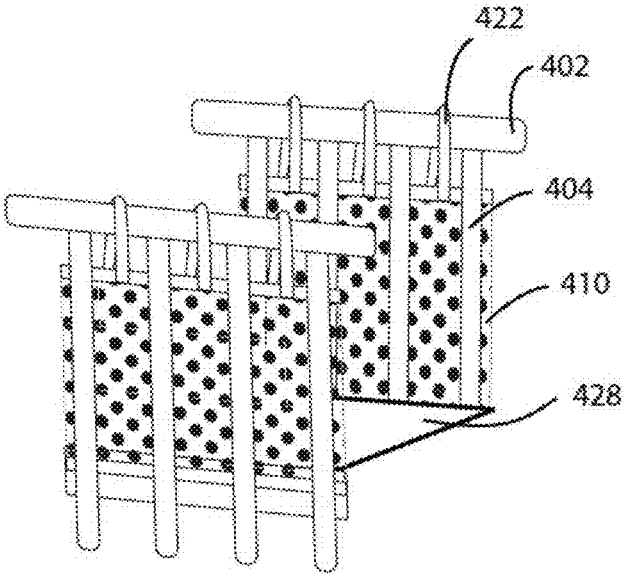
FIGS. 20A-B show an illustration of a crib liner with an underneath mattress fabric, according to one example embodiment of the present invention.
Figure 20B:
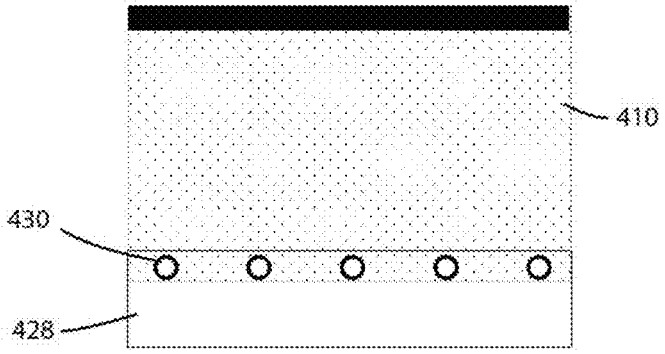

In another embodiment, the crib shield system may comprise a crib liner with two side panels 106,108, two end panels 102,104, and a bottom panel 428, where the side and end panels are attached to the bottom panel, as is shown in further detail in FIGS. 20A-20B.

Figure 9A:
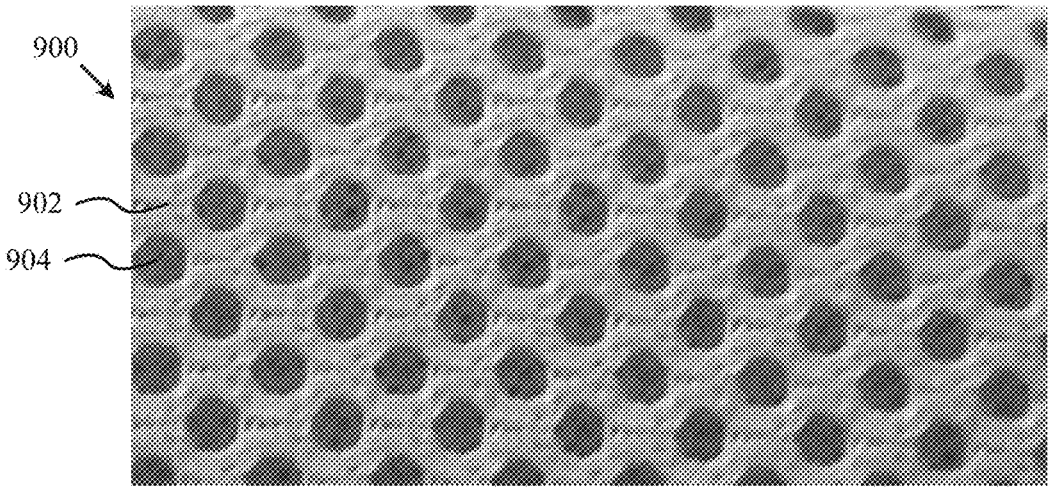
FIGS. 9A-9C show illustrations of an exemplary breathable material, according to one example embodiment of the present invention.
Figure 9B:
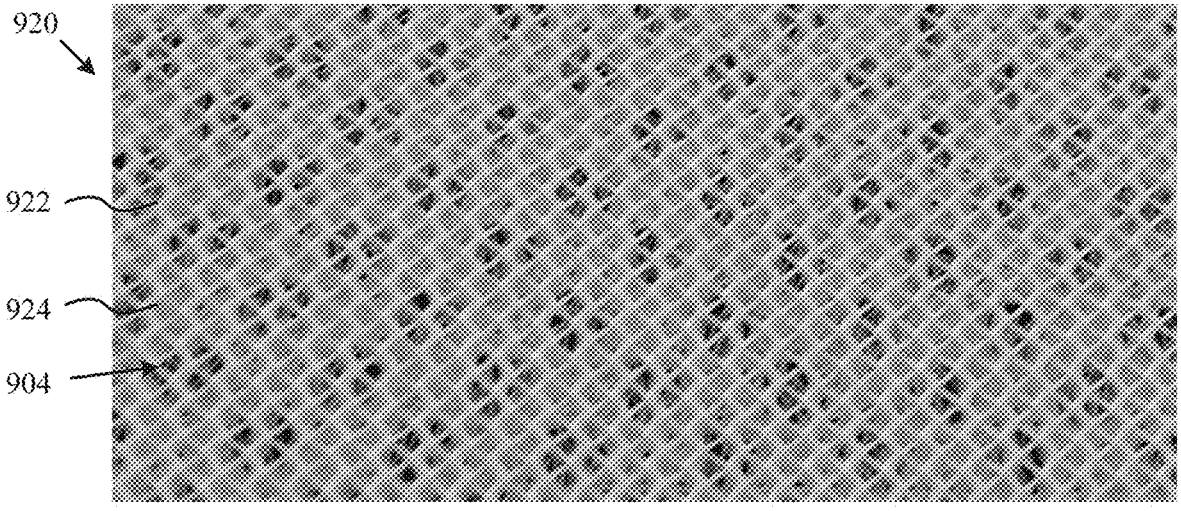
Figure 9C:
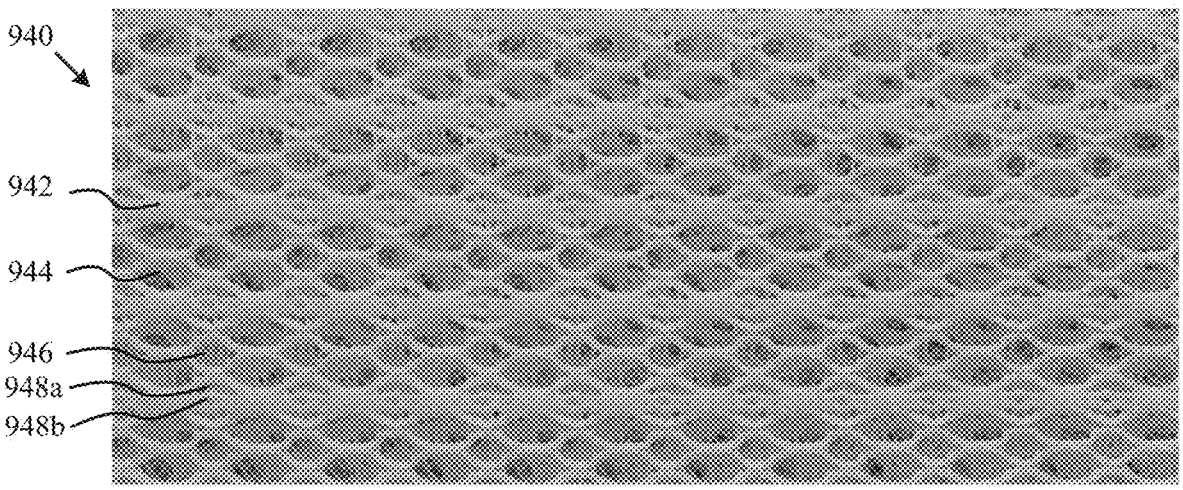

FIGS. 9A-9C show illustrations of exemplary breathable materials according to various embodiments of the present invention. FIG. 9A illustrates an exemplary breathable material 900. In the illustrated embodiment, the breathable material 900 includes a front substructure 391 composed of a woven material. The woven portion of the front substructure 391A is illustrated at 902. The woven material 902 is the portion of the front substructure 391A with which a pile substructure 393 may be attached and/or integrated. The woven material 902 is configured with openings 904, which are voids lacking any material. These openings 904 do not have any pile substructure 393 attached, and as such, may be configured to create channels between the front substructure and the back substructure. An exemplary opening 904 may be 1-6 millimeters and preferably 2-4 millimeters in diameter. As illustrated, the exemplary openings 904 are round, although other shapes are available (e.g., oval, triangle, etc.).

FIG. 9B illustrates an exemplary breathable material 920. In the illustrated embodiment, the breathable material 920 includes a front substructure 391B with a plain weave woven portion 922 with openings 924, thereby creating a "netting" pattern. In this exemplary weave configuration, the woven portion 922 is reduced, thereby increasing airflow, but diminishing the distinct channels found in openings 904. Further, the fine pattern of the woven portion 922 lacks a perceivable ornamental pattern when the liner is viewed as a whole. For this reason, in many embodiments, the breathable material 920 is used as an interior layer when two or more breathable materials are layered together (e.g., embodiments combined to create a more durable crib liner that retains breathability), as further discussed in conjunction with FIGS. 12A-12C. As shown by openings 904 in FIG. 9B, the back substructure 392B may be comprised of the front substructure 391A from breathable material 900. Thus, the fabric pattern of the front substructure need not mirror the fabric pattern of the back substructure in the various embodiments.

FIG. 9C illustrates an exemplary breathable material 940. In the illustrated embodiment, the breathable material 940 includes a front substructure 391C composed of a cableweave fabric. The woven portion of the front substructure 391C is illustrated at 942. The woven material 942 is the portion of the front substructure 391C with which a pile substructure 393 may be attached and/or integrated. The woven material 942 is configured with primary openings 944 (which may also be referred to as first openings), which are voids lacking any material. An exemplary primary opening 944 may be 1-6 millimeters and preferably 2-4 millimeters in diameter, similar to opening 904 of FIG. 9A. The front substructure 391C may also include secondary openings 946, which are smaller than primary openings 944. Additionally, the woven portion may include even smaller openings 948*a* and 948*b* (which may also be referred to as third openings) incorporated into the fabric pattern, in which the openings are smaller than openings 942 and 944. The benefit of two or more opening sizes in the fabric pattern is the ability to create a fabric that has increased breathability by reducing the amount of thick woven portions (e.g., 902) while maintaining fabric strength by having many interwoven threads. For example, a secondary opening 946 may be located at the intersection of four primary openings (first openings), thus reducing the amount of woven material between the primary openings. As another example, the third openings may be located between the first openings and second openings in order to further reduce the amount of woven material. Additional openings, such as secondary openings and third openings, further improve the air permeability (or suffocation resistance level) of the breathable material. Further, the larger openings 944, in combination with the other openings, create a perceivable ornamental pattern when the liner is viewed as a whole. The various openings (e.g., 944 and 946) do not have any pile substructure 393 attached, and as such, may be configured to create channels between the front substructure and the back substructure.

The air permeability of breathable materials 900, 920, and 940 may allow the breathable material to be layered with other breathable material (e.g., 900, 920, 940, etc.) to create a layered crib liner, while still maintaining the air permeability (CFM).

Figure 12A:
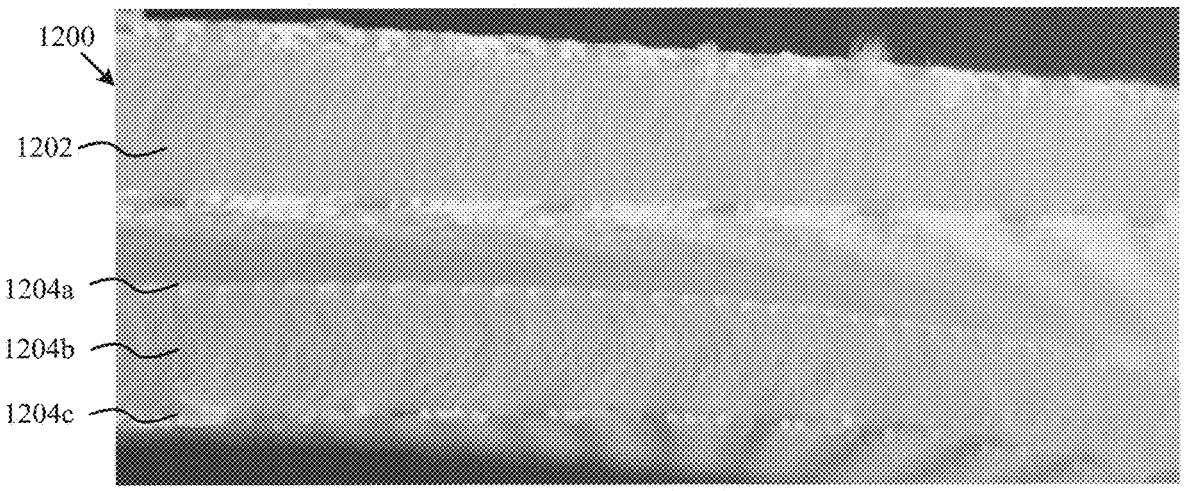
FIGS. 12A-12C show illustrations of exemplary breathable material combinations composed of more than one layer of breathable material, according to one example embodiment of the present invention.

Testing was conducted by Bureau Veritas in accordance with ASTM D737 standards to determine the air permeability (CFM) of a single layer of breathable material 900. Additionally, various combinations of layered breathable materials 900, 920, and 940—such as those described in paragraph 0129—were also tested to determine air permeability. The single layer of breathable material 900 with a thickness of 0.13 inches provided an air permeability of 1013.1 CFM, similar to the 1.6 cm $H_2O$ discussed in paragraph 0067 above. Adjusting the properties (e.g., thickness, weave pattern, etc.) of the single layer of a breathable material may allow the air permeability to achieve an air permeability of at least 1250 CFM. In contrast, competing crib bumpers provide a CFM of less than 100 CFM. Various combinations of layers of breathable material provided CFM ranging from 384 CFM to above 500 CFM. For example, two exemplary combinations shown in FIGS. 12A and 12C provided CFMs of 536.6 and 520.5, respectively. Adjusting the properties (e.g., thickness, weave pattern, etc.) of the layered breathable material may allow the air permeability to achieve an air permeability of at least 900 CFM.

Figure 10:
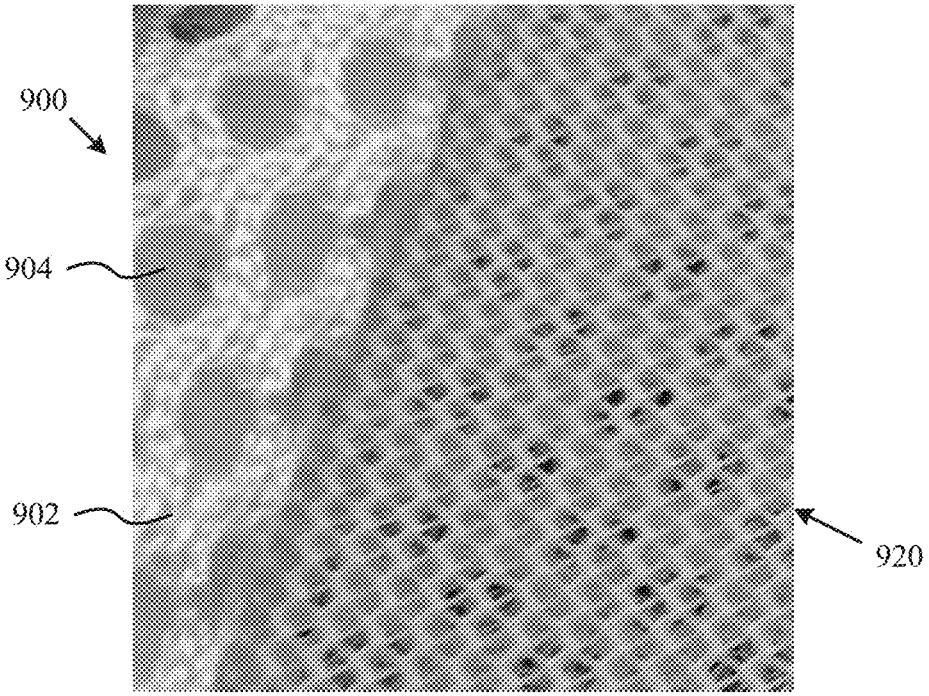
FIG. 10 shows an illustration of two exemplary breathable material layers, according to one example embodiment of the present invention.

FIG. 10 shows an illustration of two exemplary breathable materials according to at least one embodiment of the present invention. In particular, breathable material 900 with openings 904 is part of a multi-layer breathable material further including breathable material 920. The large openings 904 of breathable material 900 is evident next to the finer plainweave fabric pattern of breathable material 920.

Figure 11A:
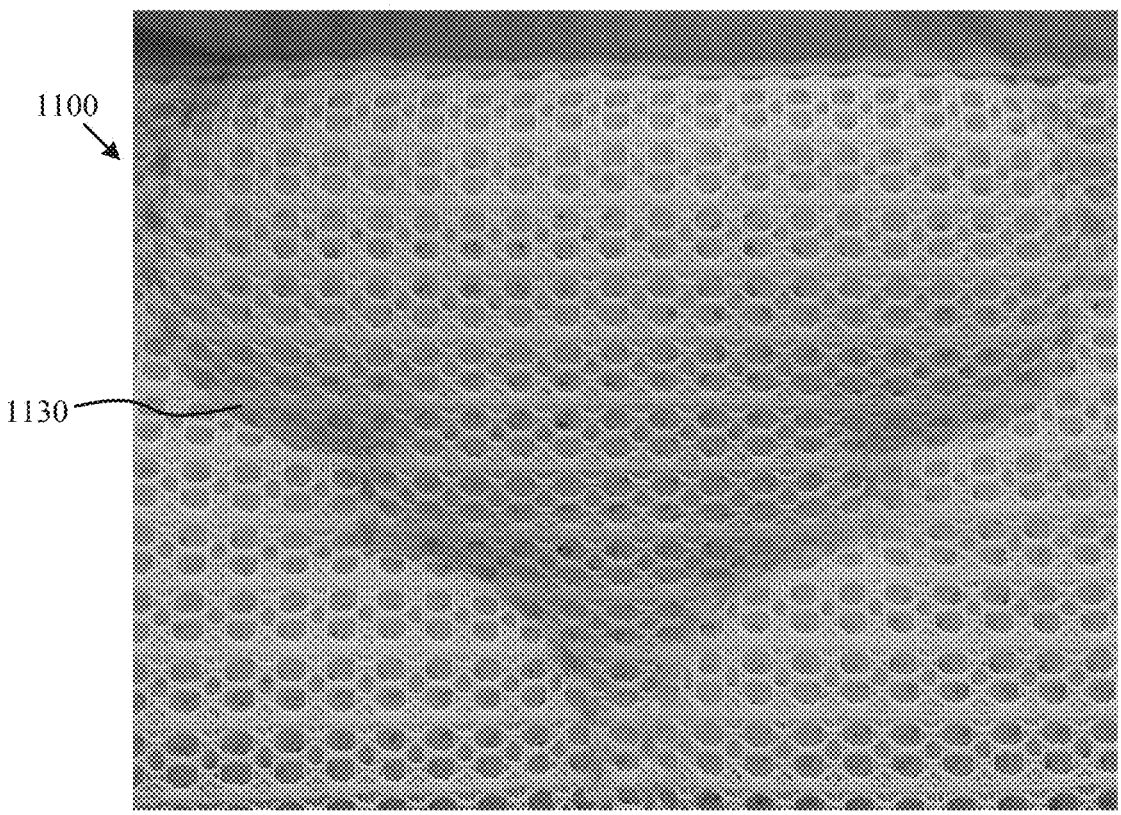
FIGS. 11A-11B show illustrations of two exemplary compartmentalized portions of a breathable material, according to one example embodiment of the present invention.
Figure 11B:
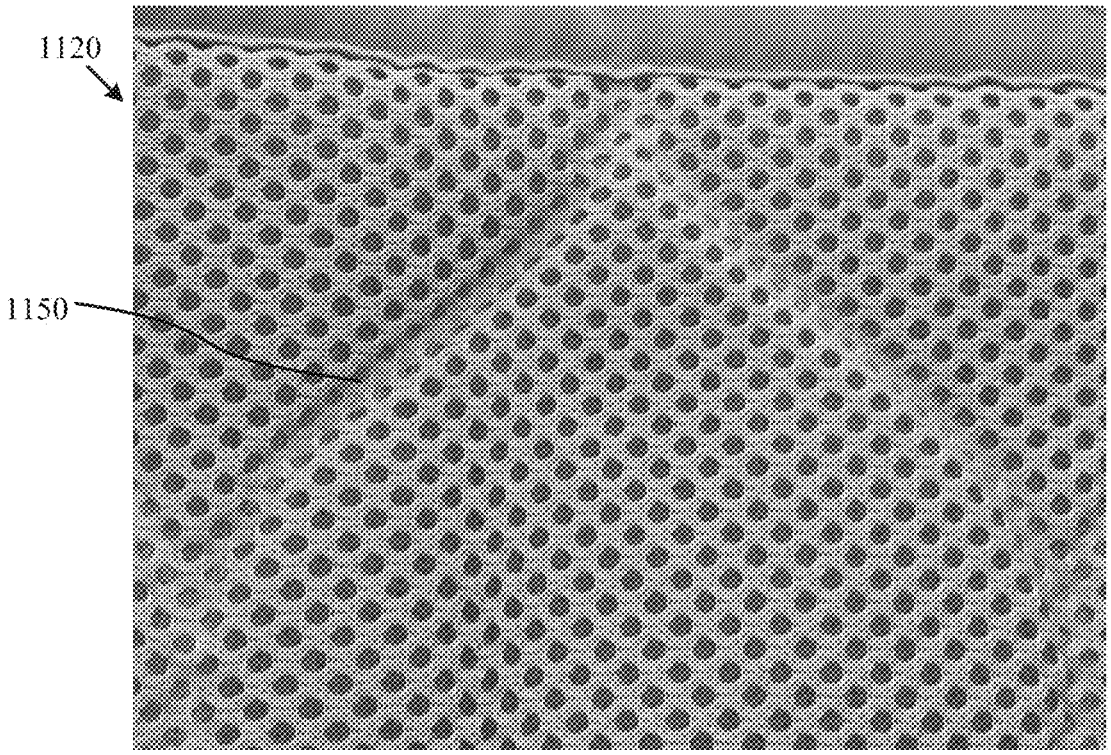

FIGS. 11A-11B show illustrations of two exemplary compartmentalized portions of a breathable material. FIG. 11A illustrates an exemplary embodiment in which at least one layer of breathable material 1100 is stitched 1130 to create distinct "compartments." These compartments may be stitched 1130 in any ornamental pattern, such as illustrated design. The stitching 1130 may be used to improve the durability of one layer of breathable material, or alternatively, to strengthen liners configured of multiple layers of breathable material. The compartments provide additional rigidity to the layer(s) of breathable material, especially configurations of crib liners that have more than one layer of breathable material. For example, the compartmented breathable material 1100 resists torsional strain better than breathable material that is not compartmented/quilted. Further, the compartmented breathable material 1100 may be more durable over repetitive wash cycles, and further, less susceptible to deformity as a result of being repetitively compressed/crushed (e.g., an infant repeatedly stepping on the crib liner). FIG. 11B illustrates an exemplary embodiment in which at least one layer of breathable material 1120 is embossed, thereby forming compartments similar to those illustrated by FIG. 11A. The embossing 1150 may be limited to one layer of breathable material 1120 (which may be configured of a front, pile, and back substructure) or may connect two or more layers of breathable material. The embossing of breathable material improves the properties of the breathable material 1120 in the same manner that the stitching improved the properties of breathable material 1100. Typically, heat and pressure is used to emboss the one or more layers of breathable material 1120.

Figure 12B:
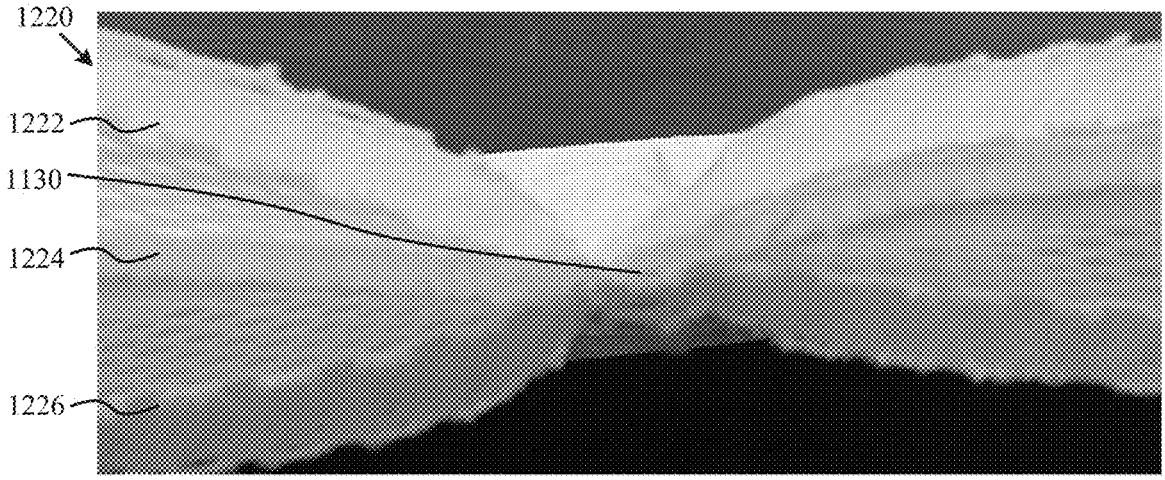
Figure 12C:
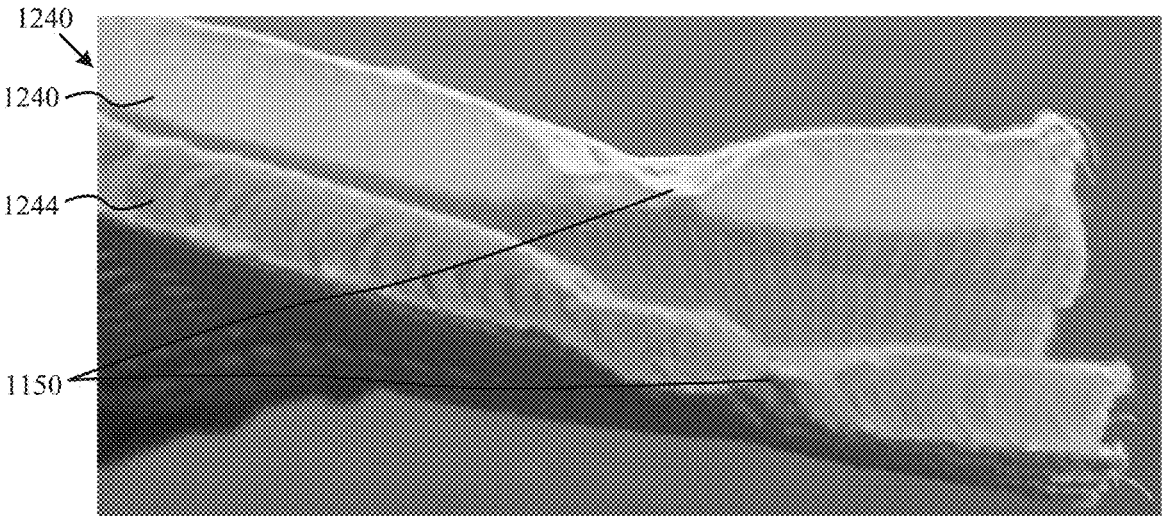

FIGS. 12A-12C show illustrations of various exemplary breathable material combinations composed of more than one layer of breathable material according to multiple embodiments of the present invention. FIG. 12A illustrates an exemplary crib liner cross section 1200 configured with two layers of breathable material, 1202 and 1204. In the exemplary illustrated embodiment, layer 1202 is 4 mm thick and layer 1204 is 3 mm thick in order to achieve a total thickness of approximately 7 mm. Layers with varying thicknesses may be combined to achieve the desired total thickness. This thicker breathable material combination improves the padding properties of the crib liner while having a negligible effect on breathability. The thicker breathable material may be achieved with a single layer, which may range from 1 mm to 15 mm. However, a thicker single layer may be more susceptible to torsional strain. Further, a single layer with a thickness greater than 5 mm increases manufacturing costs.

As illustrated in FIG. 12A, an exemplary breathable material layered to form cross section 1200 may include a front substructure 1204, a pile substructure 1204*b*, and a back substructure 1204*a*. In the illustrated embodiment, back substructure 1204*a* is a the fine woven portion 922.

FIG. 12B illustrates an exemplary crib liner cross section 1220 configured with three layers of breathable material, 1222, 1224, and 1226, thereby creating a breathable material combination with a total thickness of 10 mm. An exemplary cross section of stitching 1130 is shown, as discussed in conjunction with FIG. 11A. As shown, the exemplary stitching 1130 binds all three layers. The other embodiments, the stitching may bind only one layer or less than all of the layers.

FIG. 12C illustrates an exemplary crib liner cross section 1240 configured with three layers of breathable material, 1242 and 1244. An exemplary cross section of embossing 1150 is shown, as discussed in conjunction with FIG. 11B. As shown, the exemplary embossing 1150 only binds each individual layer; the embossing does not necessarily bind the layers together. However, the embossing 1150 may bind more than one layer.

Figure 13:
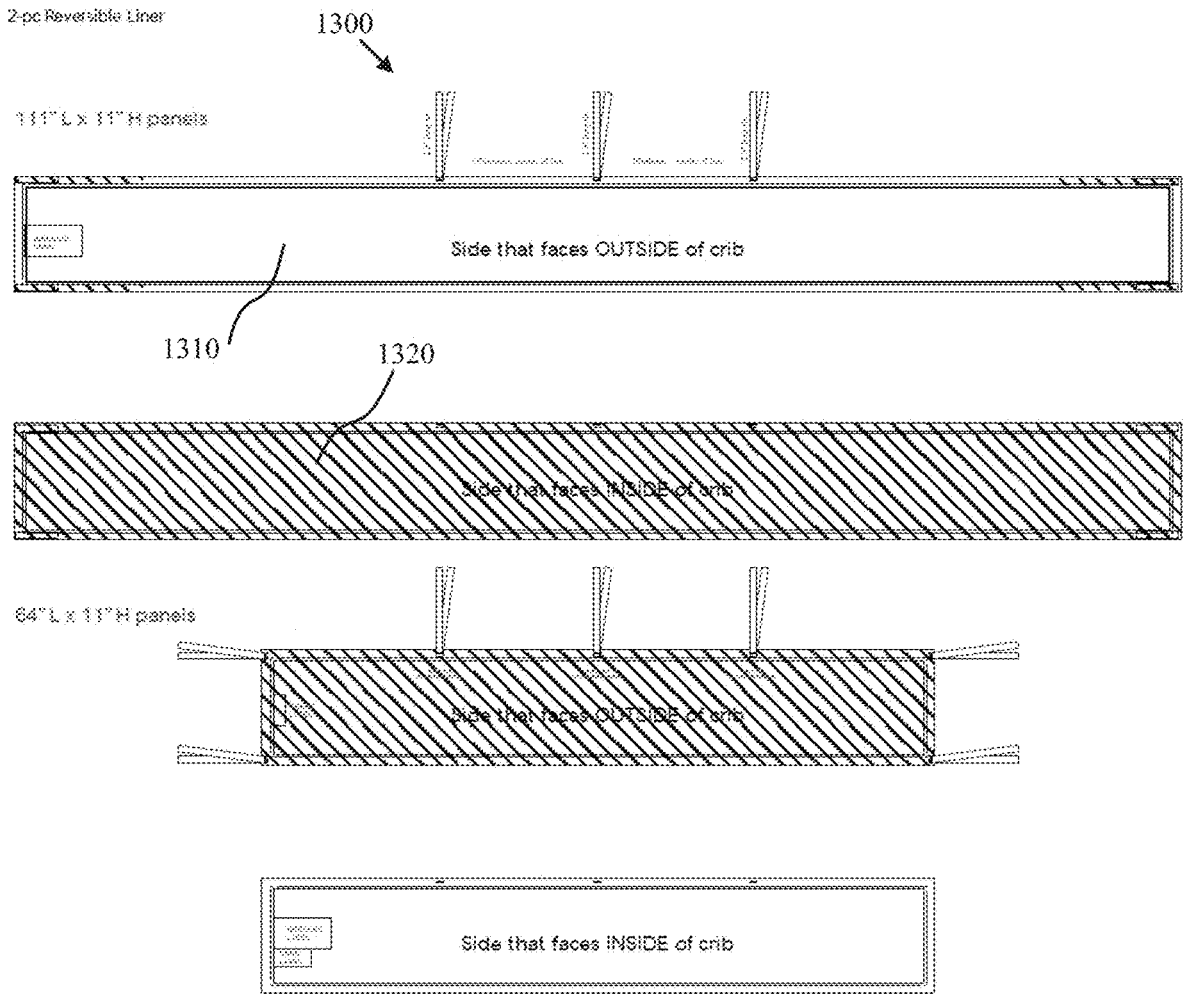
FIG. 13 show illustrations of an exemplary crib liner, which may be reversible, according to one example embodiment of the present invention.

FIG. 13 show illustrations of an exemplary crib liner, which may be reversible, according to various embodiments of the present invention. In many embodiments, the breathable material will have a different fabric weave, fabric color, and/or ornamental features on one side of the panel, 1310, compared to the opposite side of the panel, 1320. This difference in fabric weave, fabric color, and/or ornamental features (e.g., stitching, embossing, fabric shapes, etc.) provides at least two options for sides of the panel which may be exposed to the outside of the crib (and conversely, the inside of the crib). In such configurations, the crib liner is sized and shaped to be reversible. Further, in such configurations, the various fastening apparatus are also configured to be used with either side of the panel exposed to the outside of the crib (i.e., reversible). In some embodiments, the breathable material will have a front substructure with one color while a back substructure has a different color. In such a configuration, the breathable material may be one layer of breathable material (e.g., breathable padded mesh, as shown in FIG. 2F). In embodiments with more than one layer of breathable material, such as illustrated in FIG. 12A-C, different layers of breathable material may be combined to create a reversible liner. For example, one layer of breathable material may be embossed with a pattern while the other layer of breathable material lacks embossing. As another example, both breathable material layers may be embossed, but with different patterns. As yet another example, one layer of breathable material may have a different fabric weave (e.g., FIG. 9A) compared with the other layer of breathable material (e.g., FIG. 9C). Additionally, the color of the layers of breathable material may differ.

Figure 14:
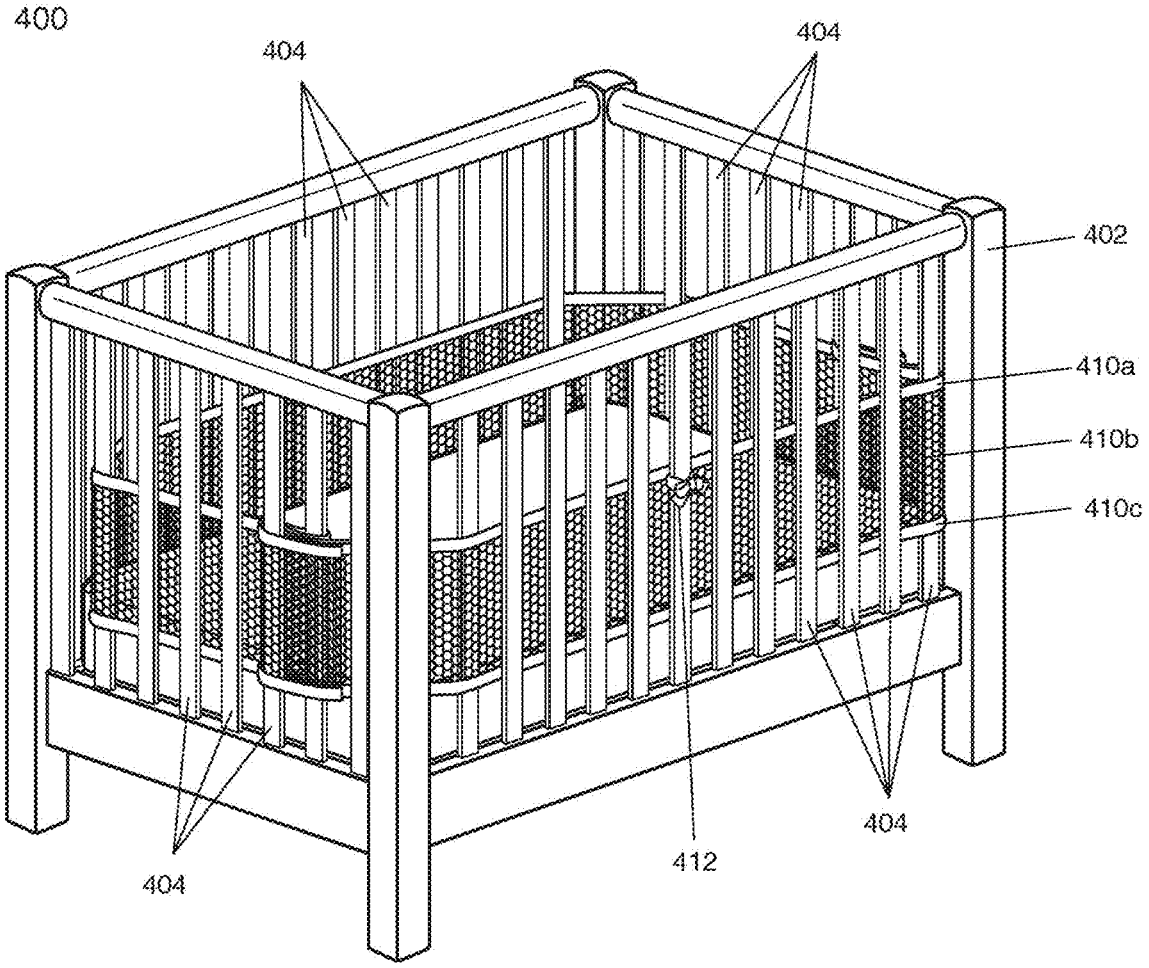
FIG. 14 shows an illustration of one embodiment of a crib liner, according to one example embodiment of the present invention.

FIG. 14 shows a crib liner according to one embodiment of the disclosure. A crib frame 402 may include a number of slats 404. A crib liner 410 may be weaved in and out of various slats 404. The crib liner 410 may provide cushioning for a child in the crib 402 to prevent injury from impact with the slats 404. The crib liner 410 may also provide a barrier to prevent a child in the crib 402 from extending appendages through the slats 404. The crib liner 410 may include a top portion 410*a* and a bottom portion 410*b* separated by a single layer mesh fabric 410*c*. The mesh fabric 410*c* includes a number of holes allowing circulation of air as described in detail above.

The top portion 410*a* and the bottom portion 410*b* of the crib liner 410 may be similar materials or different materials. In one embodiment, the top portion 410*a* and the bottom portion 410*b* may be fabric material provided for aesthetic purposes to improve the appearance of the mesh fabric 410*c*. According to another embodiment, the top portion 410*a* and the bottom portion 410*b* may be a cushioning material, such as fabric material filled with padding.

The crib liner 410 may be weaved in and out of each of the slats 404 as shown in FIG. 14 and secured to the slats 404 by a fastener 412. The fastener 412 may be, for example, a ribbon that is tied around one of the slats 404 and tied in a bow. Although only one fastener 412 is illustrated, additional fasteners may be included to provide additional support.

According to one embodiment, the crib liner 410 may be a one-piece liner wrap design. The crib liner 410, when a one-piece liner wrap design, may be adjusted for different crib sizes by wrapping the liner 410 multiple times around the slats 404 to consume a portion of the liner 410 in excess length that the perimeter of the crib 402. According to other embodiments, the crib liner 410 may be a multi-piece liner. For example, the crib liner 410 may include several lengths of shorter material, which may be assembled together to form an appropriate length for the crib 402. Thus, the crib liner 410 may be adapted for use on cribs of different sizes.

Additional detailed illustrations of the crib liner 410 are shown in FIGS. 15A-C. As shown in FIG. 15 the crib liner 410 may be weaved through the slats 404 only at corners of the crib 402. Installing the crib liner 410 by weaving through the slats 404 at corners of the crib 402 may decrease the installation time of the crib liner 410 on the crib 402.

Figure 16A:
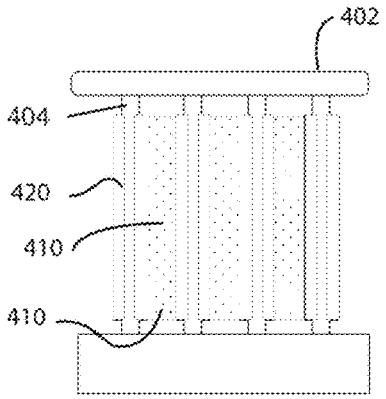
FIGS. 16A-C shows an illustration of a crib liner with crib slat pads, according to one example embodiment of the present invention.
Figure 16B:
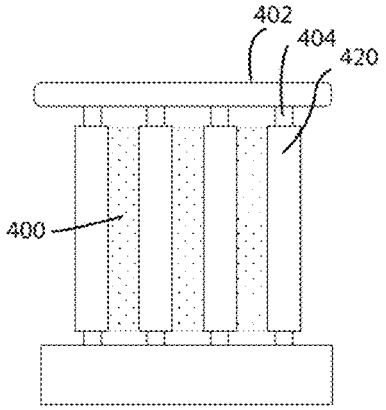
Figure 16C:
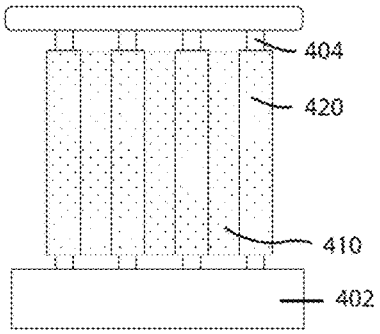

Further details of the crib liner 410 are described below with reference to FIGS. 16-20. FIGS. 16A-C shows an illustration of the crib liner 410 having crib slat pads according to embodiments of the disclosure. FIG. 16A illustrates a view of a crib liner 410 with crib slat pads 420 as seen from the outside of the crib after installation of the crib liner 410. The crib slat pads 420 cover at least the portion of the slats 404 facing inside the crib 402. The crib slat pads 420 may be made of fabric or other materials.

The crib slat pads 420 may be attached to the slats 404 through attachment mechanisms such as, for example, sewing, snapping, tying, zipping, Velcroing, buttoning, free form molding, clipping, and/or strapping the slat pads 420 to the slats 404. According to one embodiment, the slat pads 420 are separate pieces that are inserted between the slats. According to another embodiment, the slat pads 420 line the inside of the crib 402 and adhere to the slats 404. FIG. 16B shows the crib liner 410 with slat pads 420 as viewed from the inside of the crib 402. The slat pads 420 may cover substantially all of the slat 404 facing inside the crib.

In certain embodiments, such as that of FIG. 16A, the slat pads 420 do not extend the entire circumference of the slat 404 such that a portion of the slat 404 is exposed. According to another embodiment, the slat pads 420 may be installed behind the crib liner 410 as shown in FIG. 16C. In this embodiment, the crib liner 410 may be attached to the front of the slat pads 420.

Figure 17:
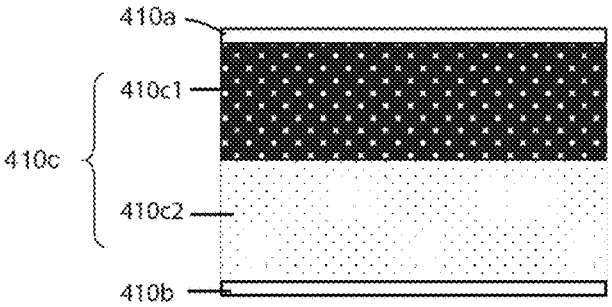
FIG. 17 shows an illustration of a two-part liner system, according to one example embodiment of the present invention.

FIG. 17 shows a two-part liner system. According to one embodiment, the mesh 410*c* of the crib liner 410 may be comprised of multiple fabrics or a combination of other materials. For example, the mesh 410*c* may be divided into an upper fabric 410*c*1 and a lower fabric 410*c*2. The lower fabric 410*c*2 may be selected to be a fabric having higher breathability than the upper fabric 410*c*1. Thus, additional airflow may be allowed into the crib 402 at the child's head level.

Other configurations of the crib liner 410 with one or more fabric layers in the mesh are possible. According to one embodiment, the mesh 410 may include two or more cotton or poly-breathable outer layers with a breathable spaces mesh in-between the two or more outer layers. According to another embodiment, the mesh 410 may include two or more cotton or poly-breathable outer layers with a breathable poly foam in-between. According to yet another embodiment, a breathable poly foam may be placed in-between a thin mesh and a spacer mesh. Each of these configurations may comprise the entire liner 410 or may be added to the crib liner 410 as additional layers. Further, these configurations may be applied to any of the embodiments described in this disclosure.

Figure 18:
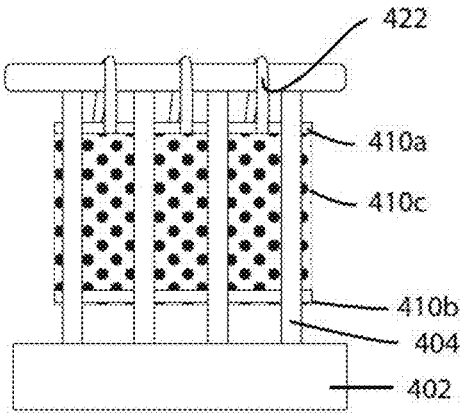
FIG. 18 shows an illustration of a crib liner with attachment devices, according to one example embodiment of the present invention.

FIG. 18 shows the crib liner 410 with top rail according to one embodiment of the disclosure. As described above, the crib liner 410 may be attached to the crib 402 through various mechanisms. According to one embodiment, straps 422 are attached to the crib liner 410 such that the strap 422 may be extended over a rail of the crib 402 and attached again to the crib liner 410. The attachment 422 may be straps, ties, Velcro, buttons, snaps, and/or a zipper.

Figure 19A:
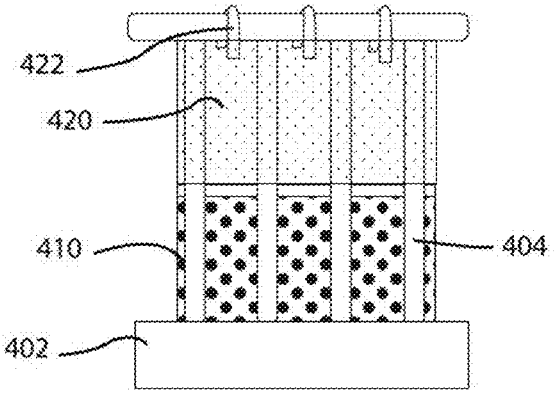
FIGS. 19A-B show an illustration of one embodiment of a crib liner with extended length, according to one example embodiment of the present invention.

FIG. 19A shows the crib liner 410 attached to a second crib liner 424. As a child grows the crib liner 410 may become insufficient to protect the child from the dangers of the slats 404. The second crib liner 424 may be attached to the crib liner 410 to extend the height of the crib liner 410. According to one embodiment, the second crib liner 424 may be the same material as the crib liner 410. However, the second crib liner 424 may also be different material than the crib liner 410. For example, the crib liner 410 may be a more breathable material than the second crib liner 424 to allow increased airflow to the child in the crib 402 when the child is laying down and sleeping. The second crib liner 424 may include attachment 422 as described above for attaching the second crib liner 424 and the first crib liner 410 to the crib 402.

Figure 19B:
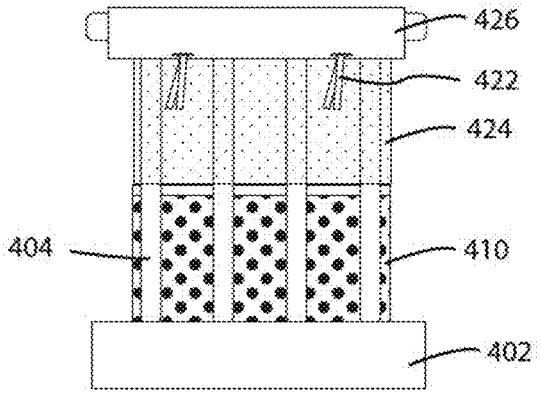

FIG. 19B shows the crib liner of FIG. 19A having the crib liner 410 and the second crib liner 424 may include a padded cover 426. The padded cover 426 may cover a portion of the crib 402 to protect a child from impact with the hard surfaces of the crib 402. The cover 426 may include slits through which the attachments 422 enter and exit the cover 426. The cover 426 may be installed on, for example, a top railing of the crib 402. However, the cover 426 may also be installed on other longitudinal structures of the frame from which the liners 410 and 424 may extend.

FIGS. 20A-B show a crib liner 410 with an underneath mattress fabric 428. The fabric 428 may be attached to the liner 410 or structurally integrated into the crib liner 410. Extending the crib liner 410 underneath a mattress with the fabric 428 may prevent the liner 410 from slipping and prevents a child from extending appendages into otherwise unprotected spaces. The fabric 428 may be attached to one portion of the liner 410 and then stretched and attached to another portion of the liner 410 to allow the fabric 428 to fit cribs of different sizes. The fabric 428 may be attached to the liner 410 through fasteners 430 including sewing, strapping, tying, Velcroing, snapping, and/or zipping.

FIG. 20B shows the crib liner in an unattached laid flat position. The bottom panel 428 may have substantially the same length and width as a crib mattress. The side panels 106,108 may have substantially the same length as the length of the bottom panel 428. The end panels 102,104 may have substantially the same length as the width of the bottom panel 428. In this embodiment, the crib liner may be placed directly on top of the mattress, and the side and end panels attached to the four sides of the crib using fasteners 430, which may be disposed continuously or intermittently along the outer edges of the side and end panels.

Figure 21A:
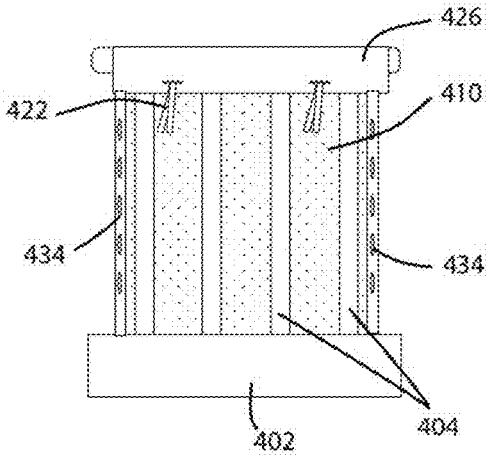
FIGS. 21A-B show an illustration of one embodiment of an expandable crib liner, according to one example embodiment of the present invention.
Figure 21B:
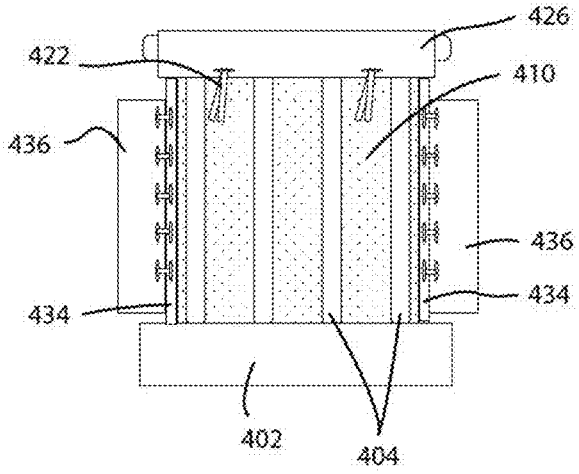

FIGS. 21A-B show a crib liner 410 with a receptor 434 for additional connecting pieces such as extra panels 436. Through the receptor 434 additional components may be affixed to the liner 410 though any of the attachment mechanisms described above. According to one embodiment the additional components may be, for example, the panels 436.

In some exemplary embodiments, the panels are formed substantially of a breathable material (e.g., mesh-type material). However, in some configurations, the panels may be formed of less than substantially of a breathable material. For example, a majority of the area of a panel may be formed of a breathable material. In other configurations, less than a majority of a panel may be formed of a breathable material, such as some of the configurations discussed herein.

The panels formed of the mesh-type material may be used in combination with one or more layers of other material adjacent to the mesh-type material. For example, in one embodiment the body portion of the panels may be formed with strips of padded material attached to the mesh-type material on one side. The strips of padded material may be disposed such that when the panels are attached to a crib, the padded materials line up with the vertical support elements of the crib and offset the mesh-type material from the vertical support elements, thus providing additional padding. The padded material may be any suitable material, not just the aforementioned mesh-type material.

The breathable materials allow for full air circulation. When a padded, soft breathable mesh material is utilized, further protection is provided to a child from bodily harm. When using one or more of the breathable mesh materials described herein, it is preferred that little rebreathing of carbon dioxide occur when a child's face is in direct contact with the material One skilled in the art will recognize that various types of padding may be used in addition to the breathable material in order to form one or more of the shapes of the objects previously described herein. Further, for example, such padding materials may be the breathable padded mesh material itself and/or other breathable materials, such as cotton, jersey, flannel, polyester, nylon, rayon, gabardine, terry cloth, etc.

The preceding described embodiments are illustrative of the practice of the invention. It is to be understood, therefore, that other expedients known to those skilled in the art or disclosed herein may be employed without departing from the invention or the scope of the appended claims. For example, various apparatus or steps of one embodiment described herein may be used with one or more other embodiments described herein to form various combinations of methods, systems, or apparatus contemplated by the present invention. As such, the present invention includes within its scope other methods, systems and apparatus for implementing and using the invention described herein.

What is claimed is:

1. A crib shield system, suitable for use with a crib, wherein the crib has a first and second side rail and a first and second endboard; wherein the first and second side rails and first and second endboards are configured for receiving a rectangular-shaped mattress; wherein the crib also includes four corner posts, wherein each corner post is constructed as part of a side rail, an endboard, or both; wherein at least one of the first and second side rails or the first and second endboards has a horizontal top bar and a plurality of vertical spaced support elements, the crib shield system comprising:

a mesh body portion, further comprising a first mesh-type material and a second mesh-type material independent from the first mesh-type material;

wherein the first mesh-type material comprises a front layer, a middle layer, and a back layer, the first mesh-type material is directly attached to the second mesh-type material without an intermediate layer, both the first and second mesh-type materials include openings too small to permit an infant to insert a finger or toe there through;

wherein the front layer and back layer have different fabric weaves.

2. The crib shield system of claim 1, wherein the second mesh-type material has a front layer with a different fabric weave compared with the first mesh-type material.

3. The crib shield system of claim 1, wherein the front layer, middle layer, and back layer of the first mesh-type material are quilted together along at least two integration seams crossing the mesh body portion; wherein the at least two integration seams cross each other to create a pattern in the mesh body portion; and wherein the quilting anchors the middle layer to the front layer and back layer along the at least two integration seams.

4. The crib shield system of claim 3, wherein the second mesh-type material is integrated with the first mesh-type material along the at least two integration seams.

5. The crib shield system of claim 3, wherein the at least two integration seams are stitching.

6. The crib shield system of claim 3, wherein the at least two integration seams are embossing.

7. The crib shield system of claim 3, wherein the first-mesh-type material and the second mesh-type material are configured to be substantially the same height and length; and wherein the first mesh-type material and the second mesh-type material are configured to be secured together to form a single panel.

8. The crib shield system of claim 3, wherein the mesh body portion further comprises a third mesh-type material.

9. The crib shield system of claim 8, wherein the third mesh-type material comprises a mesh comprising at least one weave pattern different from the first mesh-type material and the second mesh-type material.

10. The crib shield system of claim 9, wherein at least one of the mesh-type materials comprises a front substructure, a back substructure, and a padding substructure.

11. The crib shield system of claim 10, wherein the padding substructure is integrated with at least one of the front substructure or back substructure.

12. The crib shield system of claim 1, wherein the first mesh-type material comprises a woven portion with a first size of openings too small to permit an infant to insert a finger or toe there through, and wherein the first mesh-type material comprises a woven portion with a second size of openings too small to permit an infant to insert a finger or toe there through.

13. The crib shield system of claim 12, wherein the woven portion of the first size of openings is integrated with the woven portion of the second size of openings.

14. The crib shield system of claim 13, wherein the woven portion of the first size of openings and the woven portion of the second size of openings are integrated together by weaving.

15. The crib shield system of claim 12, wherein the first mesh-type material comprises a woven portion with a third size of openings.

16. The crib shield system of claim 12, wherein the first mesh-type material comprises a front substructure, a back substructure, and a pile substructure.

17. The crib shield system of claim 16, wherein the pile substructure is integrated with at least one of the front substructure or back substructure.

18. The crib shield system of claim 17, wherein front substructure comprises the woven portion of the first size openings, the woven portion of the second size openings, and the woven portion of the third size openings; and wherein the pile substructure is integrated with the woven portion of the first size openings, the woven portion of the second size openings, and the woven portion of the third size openings.

* * * * *